US009027825B2

(12) United States Patent
Baker et al.

(10) Patent No.: US 9,027,825 B2
(45) Date of Patent: May 12, 2015

(54) CONTAINER ASSEMBLY AND FOLDABLE CONTAINER SYSTEM

(75) Inventors: Steven R. Baker, Omaha, NE (US); Rebecca A. Bortolotti, Omaha, NE (US); Raquelle E. Hunter, Omaha, NE (US); Krista K. McDonald, Murray, NE (US); Kari Ann Brackelsberg Pappas, Omaha, NE (US); Michael Alan Pence, Chicago, IL (US); Jess Cristen Sweley, Omaha, NE (US); MaryKay Skrypec, Arlington Heights, IL (US); Ryan Fitzgibbon, Midland, MI (US); Judy Guo, San Francisco, CA (US); Grace J. Hwang, Menlo Park, CA (US); Laura Diane Janisse, Oakland, CA (US); Nicole Sarah Kahn, San Francisco, CA (US); Elle Luna, San Francisco, CA (US); Santiago Prieto, San Francisco, CA (US); Jenny Fan Raj, San Francisco, CA (US); Lauren Shimek, San Ramon, CA (US); Neil Owen Stevenson, Chicago, IL (US); Dorinda Von Stroheim, Alameda, CA (US)

(73) Assignee: ConAgra Foods RDM, Inc., Omaha, NE (US)

( * ) Notice: Subject to any disclaimer, the term of this patent is extended or adjusted under 35 U.S.C. 154(b) by 331 days.

(21) Appl. No.: 13/494,136

(22) Filed: Jun. 12, 2012

(65) Prior Publication Data

US 2013/0327819 A1 Dec. 12, 2013

(51) Int. Cl.
*B65D 5/49* (2006.01)
*B65D 25/00* (2006.01)
(Continued)

(52) U.S. Cl.
CPC ..... *B65D 25/00* (2013.01); *B65D 77/2032* (2013.01); *B65D 81/3216* (2013.01)

(58) Field of Classification Search
USPC ..... 229/120.32, 169; 206/557, 524.1; 220/62.2
See application file for complete search history.

(56) References Cited

U.S. PATENT DOCUMENTS 113,893 A 4/1871 Joyce et al. ..... 200/762
166,102 A 7/1875 Hennaman ..... 220/525
(Continued)

FOREIGN PATENT DOCUMENTS

CH 672 585 12/1989
DE 28 10 175 A1 9/1979
(Continued)

OTHER PUBLICATIONS

International Search Report mailed Dec. 4, 2013 in Application No. PCT/US2013/044064.
(Continued)

*Primary Examiner* — Gary Elkins
(74) *Attorney, Agent, or Firm* — Ryan T. Grace; Advent, LLP

(57) ABSTRACT

Container assemblies can include a first container and a second container, where the second container extends into and is supported by the first container. The first container and the second container can each include a flange around the periphery of an access opening. The flange of the second container is configured to provide support for the second container via engagement with the flange of the first container. In some instances, the second container can extend into and be supported by the first container through engagement of the flange of the second container with the flange of the first container such that a side panel of the first container is not in contact with a corresponding side panel of the second container. The container assembly can also include a lid for retaining the second container in the first container and/or for sealing to the first container and/or the second container.

20 Claims, 14 Drawing Sheets

(51) Int. Cl.
*B65D 77/20* (2006.01)
*B65D 81/32* (2006.01)

(56) References Cited

U.S. PATENT DOCUMENTS

| | | | | | |
|---|---|---|---|---|---|
| 177,593 | A | | 5/1876 | Skelline | |
| 181,823 | A | | 9/1876 | Cornwall | 99/425 |
| 236,306 | A | * | 1/1881 | Cooke | 229/120.32 |
| 241,254 | A | | 5/1881 | Udell | |
| 254,770 | A | | 3/1882 | Hurd | 99/450 |
| 472,002 | A | | 3/1892 | Ross | |
| 541,397 | A | | 6/1895 | Swartout | |
| 590,212 | A | | 9/1897 | Daesch | 99/416 |
| 637,838 | A | | 11/1899 | Vernon | |
| 851,983 | A | | 4/1907 | Entringer | 210/314 |
| 899,244 | A | | 9/1908 | Chase | 99/412 |
| 902,181 | A | | 10/1908 | Tidow | 99/408 |
| 948,198 | A | | 2/1910 | Wiegand | 99/417 |
| 952,572 | A | | 3/1910 | Meyer | |
| 955,033 | A | | 4/1910 | Wing | 99/428 |
| 1,004,423 | A | | 9/1911 | Hanlon | 220/759 |
| 1,046,945 | A | * | 12/1912 | Bauer et al. | 229/120.32 |
| 1,099,603 | A | | 6/1914 | Ingersoll | |
| 1,263,004 | A | | 4/1918 | Tollagsen | 126/369 |
| 1,341,960 | A | | 6/1920 | Meyer et al. | |
| 1,347,075 | A | | 7/1920 | Wittekind | |
| 1,476,910 | A | | 12/1923 | Naugle | |
| 1,519,510 | A | | 12/1924 | Santarsiero | 99/416 |
| 1,630,787 | A | | 5/1927 | Cullen | 99/416 |
| 1,765,862 | A | | 6/1930 | Clapp | |
| 1,864,081 | A | | 6/1932 | Marr | |
| 1,906,592 | A | | 5/1933 | Hiester | |
| 1,944,089 | A | | 1/1934 | Litchfield | 150/9 |
| 1,985,978 | A | | 5/1934 | Thomas | 426/113 |
| 2,021,465 | A | | 11/1935 | Ritscher | 99/403 |
| 2,039,374 | A | | 5/1936 | Young | |
| 2,041,227 | A | | 5/1936 | Chalmers | 229/87 |
| 2,107,480 | A | | 2/1938 | Holton | |
| 2,149,872 | A | | 3/1939 | Schmidt | 229/58 |
| 2,200,977 | A | | 5/1940 | Baxter | 426/95 |
| 2,271,921 | A | | 2/1942 | Luker | |
| 2,290,396 | A | | 7/1942 | Webster | |
| 2,540,036 | A | | 1/1951 | Spencer | |
| 2,556,115 | A | | 6/1951 | Smith | 99/417 |
| 2,559,101 | A | | 7/1951 | Wool | |
| 2,576,862 | A | | 11/1951 | Smith et al. | |
| 2,591,578 | A | | 4/1952 | McNealy et al. | |
| 2,600,566 | A | | 6/1952 | Moffett | |
| 2,650,485 | A | | 9/1953 | La Greca | |
| 2,660,529 | A | | 11/1953 | Bloom | |
| 2,667,422 | A | | 1/1954 | Kauffman | 426/86 |
| 2,673,805 | A | | 3/1954 | Colman | 99/171 |
| 2,673,806 | A | | 3/1954 | Colman | 99/171 |
| 2,714,070 | A | | 7/1955 | Welch | |
| 2,741,559 | A | | 4/1956 | Banowitz | 99/171 |
| 2,758,774 | A | * | 8/1956 | Grunert et al. | 229/120.32 |
| 2,777,769 | A | | 1/1957 | Hodges | 426/113 |
| 2,801,930 | A | | 8/1957 | Paulucci | 99/193 |
| 2,805,392 | A | | 9/1957 | Schnoll | 324/706 |
| 2,852,898 | A | | 9/1958 | Berg | 53/182 |
| 2,858,970 | A | | 11/1958 | Barnes et al. | 229/55 |
| 2,865,768 | A | | 12/1958 | Barnes et al. | 99/171 |
| D185,399 | S | | 6/1959 | Tupper | |
| 2,948,454 | A | * | 8/1960 | Gillmore, Sr. | 229/120.32 |
| 2,960,218 | A | | 11/1960 | Cheeley | |
| 2,961,520 | A | | 11/1960 | Long | |
| 2,965,501 | A | | 12/1960 | Harriss | 426/120 |
| 3,012,660 | A | * | 12/1961 | Sheldon, Jr. | 206/525 |
| 3,012,895 | A | | 12/1961 | Stelnicki | |
| 3,027,261 | A | | 3/1962 | Samara | 99/171 |
| 3,035,754 | A | | 5/1962 | Meister | 229/53 |
| 3,047,199 | A | * | 7/1962 | McBain | 229/120.32 |
| 3,052,554 | A | | 9/1962 | Colman | 99/171 |
| 3,068,779 | A | | 12/1962 | Eidlisz | 219/733 |
| 3,070,275 | A | | 12/1962 | Bostrom | |
| 3,107,989 | A | | 10/1963 | Fesco | 55/381 |
| 3,109,359 | A | | 11/1963 | Falla | 99/339 |
| 3,141,400 | A | | 7/1964 | Powers | |
| 3,179,036 | A | | 4/1965 | Luker | |
| 3,191,520 | A | | 6/1965 | Halter | |
| 3,219,460 | A | | 11/1965 | Brown | |
| 3,220,635 | A | | 11/1965 | Kasting et al. | 229/57 |
| 3,220,856 | A | | 11/1965 | Vischer | |
| 3,240,610 | A | | 3/1966 | Cease | |
| 3,244,537 | A | | 4/1966 | Cease | |
| 3,246,446 | A | | 4/1966 | Powers | |
| 3,262,668 | A | | 7/1966 | Luker | |
| 3,271,169 | A | | 9/1966 | Baker et al. | |
| 3,286,832 | A | | 11/1966 | Pilger | 206/56 |
| 3,287,140 | A | | 11/1966 | Brussell | |
| 3,293,048 | A | | 12/1966 | Kitterman | 99/171 |
| 3,326,097 | A | | 6/1967 | Lokey | 93/82 |
| 3,349,941 | A | | 10/1967 | Wanderer | |
| 3,353,327 | A | | 11/1967 | Cutler et al. | 53/28 |
| 3,353,707 | A | | 11/1967 | Eyles | 206/519 |
| 3,357,152 | A | | 12/1967 | Geigel | 53/29 |
| 3,396,868 | A | | 8/1968 | Fitzgerald | 206/508 |
| 3,420,397 | A | | 1/1969 | Miller | |
| 3,421,654 | A | | 1/1969 | Hexel | |
| 3,424,342 | A | | 1/1969 | Scopp et al. | 220/793 |
| 3,445,050 | A | | 5/1969 | Peters et al. | |
| 3,447,714 | A | | 6/1969 | Elliot | |
| 3,489,075 | A | | 1/1970 | O'Reilly | 99/450 |
| 3,521,788 | A | | 7/1970 | Carter et al. | 220/675 |
| 3,547,661 | A | | 12/1970 | Stevenson | |
| 3,561,668 | A | * | 2/1971 | Bergstrom | 229/123.1 |
| 3,608,770 | A | | 9/1971 | Naimoli | 220/16 |
| 3,610,135 | A | | 10/1971 | Sheridan | |
| 3,610,458 | A | | 10/1971 | Nissley | |
| 3,615,646 | A | | 10/1971 | Neely et al. | |
| 3,620,834 | A | | 11/1971 | Duffy | 117/213 |
| 3,637,132 | A | | 1/1972 | Gray | 229/53 |
| 3,638,784 | A | | 2/1972 | Bodolay et al. | |
| 3,641,926 | A | | 2/1972 | Williams et al. | 99/448 |
| 3,647,508 | A | | 3/1972 | Gorrell | 117/38 |
| 3,669,688 | A | | 6/1972 | Thompson | |
| 3,718,480 | A | | 2/1973 | Tremblay et al. | |
| 3,741,427 | A | | 6/1973 | Doyle | |
| 3,777,447 | A | | 12/1973 | Herbine et al. | 53/36 |
| 3,811,374 | A | | 5/1974 | Mann | |
| 3,835,280 | A | | 9/1974 | Gades et al. | |
| 3,836,042 | A | | 9/1974 | Petitto | |
| 3,844,409 | A | | 10/1974 | Bodolay et al. | |
| 3,851,574 | A | | 12/1974 | Katz et al. | 426/107 |
| 3,865,301 | A | | 2/1975 | Pothier et al. | |
| 3,873,735 | A | | 3/1975 | Chalin et al. | 426/87 |
| 3,881,027 | A | | 4/1975 | Levinson | |
| 3,884,213 | A | | 5/1975 | Smith | |
| 3,884,383 | A | | 5/1975 | Burch et al. | 220/675 |
| 3,893,567 | A | | 7/1975 | Davis et al. | 206/520 |
| 3,908,029 | A | | 9/1975 | Fredrickson | |
| 3,938,730 | A | | 2/1976 | Detzel et al. | |
| 3,941,967 | A | | 3/1976 | Sumi et al. | |
| 3,956,866 | A | | 5/1976 | Lattur | 53/29 |
| 3,965,323 | A | | 6/1976 | Forker, Jr. et al. | |
| 3,970,241 | A | | 7/1976 | Hanson | 229/58 |
| 3,973,045 | A | | 8/1976 | Brandberg et al. | 426/110 |
| 3,974,353 | A | | 8/1976 | Goltsos | |
| 3,975,552 | A | | 8/1976 | Stangroom | |
| 3,983,256 | A | | 9/1976 | Norris et al. | |
| 3,985,990 | A | | 10/1976 | Levinson | |
| 4,018,355 | A | | 4/1977 | Ando | 220/522 |
| 4,031,261 | A | | 6/1977 | Durst | |
| 4,036,423 | A | | 7/1977 | Gordon | 229/43 |
| 4,038,425 | A | | 7/1977 | Brandberg et al. | 426/107 |
| 4,043,098 | A | | 8/1977 | Putnam, Jr. et al. | 53/180 M |
| 4,065,583 | A | | 12/1977 | Ahlgren | |
| 4,077,853 | A | | 3/1978 | Coll-Palagos | 204/20 |
| 4,079,853 | A | | 3/1978 | Casutt | |
| 4,082,184 | A | | 4/1978 | Hammer | 206/519 |
| 4,082,691 | A | | 4/1978 | Berger | |
| 4,096,948 | A | | 6/1978 | Kuchenbecker | |
| 4,113,095 | A | | 9/1978 | Dietz et al. | |
| 4,118,913 | A | | 10/1978 | Putnam, Jr. et al. | 53/551 |

(56) References Cited

U.S. PATENT DOCUMENTS

| | | | | | |
|---|---|---|---|---|---|
| 4,126,945 | A | | 11/1978 | Manser et al. | |
| 4,132,811 | A | | 1/1979 | Standing et al. | 426/111 |
| 4,133,896 | A | | 1/1979 | Standing et al. | |
| 4,136,505 | A | | 1/1979 | Putnam, Jr. et al. | 53/551 |
| 4,138,054 | A | | 2/1979 | Spencer | 229/23 BT |
| 4,140,889 | A | | 2/1979 | Mason et al. | |
| 4,154,860 | A | | 5/1979 | Daswick | |
| 4,156,806 | A | | 5/1979 | Teich et al. | |
| 4,164,174 | A | | 8/1979 | Wallsten | 99/415 |
| 4,171,605 | A | | 10/1979 | Putnam, Jr. et al. | 53/552 |
| 4,184,061 | A | | 1/1980 | Suzuki et al. | |
| 4,186,217 | A | | 1/1980 | Tchack | 426/523 |
| 4,190,757 | A | | 2/1980 | Turpin et al. | |
| 4,196,331 | A | | 4/1980 | Leveckis et al. | |
| D255,751 | S | | 7/1980 | Daenen | D7/667 |
| 4,219,573 | A | | 8/1980 | Borek | 426/107 |
| 4,228,945 | A | | 10/1980 | Wysocki | |
| 4,230,767 | A | | 10/1980 | Isaka et al. | 428/349 |
| 4,230,924 | A | | 10/1980 | Brastad et al. | |
| 4,233,325 | A | | 11/1980 | Slangan et al. | |
| 4,241,563 | A | | 12/1980 | Müller et al. | 53/511 |
| 4,242,378 | A | | 12/1980 | Arai | 427/264 |
| 4,257,530 | A | * | 3/1981 | Faller | 229/125.35 |
| 4,258,086 | A | | 3/1981 | Beall | |
| 4,264,668 | A | | 4/1981 | Balla | 428/195 |
| 4,267,420 | A | | 5/1981 | Brastad | |
| 4,279,933 | A | | 7/1981 | Austin et al. | 426/124 |
| 4,280,032 | A | | 7/1981 | Levinson | |
| 4,283,427 | A | | 8/1981 | Winters et al. | 426/107 |
| 4,291,520 | A | | 9/1981 | Prince et al. | 53/551 |
| 4,292,332 | A | | 9/1981 | McHam | 426/111 |
| 4,304,352 | A | | 12/1981 | Humphries | 229/31 R |
| 4,306,133 | A | | 12/1981 | Levinson | |
| 4,316,070 | A | | 2/1982 | Prosise et al. | |
| 4,317,017 | A | | 2/1982 | Bowen | |
| 4,324,088 | A | | 4/1982 | Yamashita et al. | 53/527 |
| 4,328,254 | A | | 5/1982 | Waldburger | |
| 4,335,291 | A | | 6/1982 | Ishino et al. | |
| 4,340,138 | A | | 7/1982 | Bernhardt | 206/216 |
| 4,345,133 | A | | 8/1982 | Cherney et al. | |
| 4,348,421 | A | | 9/1982 | Sakakibara et al. | 426/394 |
| 4,351,997 | A | | 9/1982 | Mattisson et al. | |
| 4,355,757 | A | | 10/1982 | Roccaforte | 229/33 |
| 4,373,511 | A | | 2/1983 | Miles et al. | 126/369 |
| 4,377,493 | A | | 3/1983 | Boylan et al. | |
| 4,389,438 | A | | 6/1983 | Ohtsuki et al. | 428/35 |
| 4,390,555 | A | | 6/1983 | Levinson | |
| 4,398,994 | A | | 8/1983 | Beckett | |
| 4,416,906 | A | | 11/1983 | Watkins | |
| 4,425,368 | A | | 1/1984 | Watkins | |
| 4,439,656 | A | | 3/1984 | Peleg | |
| 4,453,665 | A | | 6/1984 | Roccaforte et al. | 229/41 B |
| 4,461,031 | A | | 7/1984 | Blamer | 383/123 |
| 4,477,705 | A | | 10/1984 | Danley et al. | |
| 4,478,349 | A | | 10/1984 | Haverland, Jr. et al. | |
| 4,481,392 | A | | 11/1984 | Nibbe et al. | |
| 4,486,640 | A | | 12/1984 | Bowen et al. | 219/729 |
| 4,493,685 | A | | 1/1985 | Blamer | 493/235 |
| 4,496,815 | A | | 1/1985 | Jorgensen | |
| 4,517,045 | A | | 5/1985 | Beckett | 156/345 |
| 4,518,651 | A | | 5/1985 | Wolfe, Jr. | |
| 4,529,089 | A | | 7/1985 | Gasbarra et al. | 206/525 |
| 4,530,459 | A | * | 7/1985 | Maroszek | 229/117.15 |
| 4,532,397 | A | | 7/1985 | McClelland | |
| D280,058 | S | | 8/1985 | Carlson | D7/629 |
| 4,535,889 | A | | 8/1985 | Terauds | 206/527 |
| 4,552,614 | A | | 11/1985 | Beckett | 156/640 |
| 4,553,010 | A | | 11/1985 | Bohrer et al. | |
| 4,571,337 | A | | 2/1986 | Cage et al. | 426/107 |
| 4,581,989 | A | | 4/1986 | Swartley | 99/346 |
| 4,584,202 | A | | 4/1986 | Roccaforte | 426/111 |
| 4,586,649 | A | | 5/1986 | Webinger | 229/114 |
| 4,610,755 | A | | 9/1986 | Beckett | 156/634 |
| 4,612,431 | A | | 9/1986 | Brown et al. | |
| 4,626,352 | A | | 12/1986 | Massey et al. | 210/469 |
| 4,640,838 | A | | 2/1987 | Isakson et al. | 426/107 |
| 4,641,005 | A | | 2/1987 | Seiferth | |
| 4,648,549 | A | | 3/1987 | Trutna | 229/143 |
| 4,657,141 | A | | 4/1987 | Sorensen | 206/519 |
| 4,661,326 | A | | 4/1987 | Schainholz | 422/310 |
| 4,661,671 | A | | 4/1987 | Maroszek | |
| 4,661,672 | A | | 4/1987 | Nakanaga | |
| 4,677,905 | A | | 7/1987 | Johnson | 99/413 |
| 4,678,882 | A | | 7/1987 | Bohrer et al. | |
| D291,522 | S | | 8/1987 | Daenen et al. | D7/667 |
| 4,685,997 | A | | 8/1987 | Beckett | 156/629 |
| 4,697,703 | A | | 10/1987 | Will | 206/438 |
| 4,701,585 | A | | 10/1987 | Stewart | |
| 4,703,148 | A | | 10/1987 | Mikulski et al. | |
| 4,703,149 | A | | 10/1987 | Sugisawa et al. | |
| 4,705,927 | A | | 11/1987 | Levendusky et al. | |
| 4,713,510 | A | | 12/1987 | Quick et al. | |
| 4,714,012 | A | | 12/1987 | Hernandez | 99/444 |
| 4,727,706 | A | | 3/1988 | Beer | 53/434 |
| 4,734,288 | A | | 3/1988 | Engstrom et al. | 426/107 |
| 4,738,882 | A | | 4/1988 | Rayford et al. | 428/35 |
| 4,739,698 | A | | 4/1988 | Allaire | 99/410 |
| 4,739,898 | A | | 4/1988 | Brown | |
| 4,745,249 | A | | 5/1988 | Daniels | |
| 4,777,053 | A | | 10/1988 | Tobelmann et al. | |
| 4,794,005 | A | | 12/1988 | Swiontek | |
| 4,797,010 | A | | 1/1989 | Coelho | 383/109 |
| 4,801,017 | A | * | 1/1989 | Artusi | 206/524.1 |
| 4,803,088 | A | | 2/1989 | Yamamoto et al. | 426/107 |
| 4,804,582 | A | | 2/1989 | Noding et al. | 428/332 |
| 4,806,718 | A | | 2/1989 | Seaborne et al. | |
| 4,808,780 | A | | 2/1989 | Seaborne | |
| 4,810,845 | A | | 3/1989 | Seaborne | |
| 4,818,831 | A | | 4/1989 | Seaborne | |
| 4,825,025 | A | | 4/1989 | Seiferth | |
| 4,842,876 | A | | 6/1989 | Anderson et al. | |
| 4,846,350 | A | | 7/1989 | Sorensen | 206/520 |
| 4,848,579 | A | | 7/1989 | Barnes et al. | |
| 4,851,246 | A | | 7/1989 | Maxwell et al. | 426/107 |
| 4,853,505 | A | | 8/1989 | Sorenson | |
| 4,853,509 | A | | 8/1989 | Murakami | |
| 4,864,089 | A | | 9/1989 | Tighe et al. | |
| 4,864,090 | A | | 9/1989 | Maxwell et al. | |
| 4,870,233 | A | | 9/1989 | McDonald et al. | |
| 4,873,919 | A | | 10/1989 | Janssen | |
| 4,883,936 | A | | 11/1989 | Maynard et al. | |
| 4,892,744 | A | | 1/1990 | Ylvisaker | 426/111 |
| 4,896,009 | A | | 1/1990 | Pawlowski | |
| 4,899,925 | A | | 2/1990 | Bowden et al. | |
| 4,904,488 | A | | 2/1990 | LaBaw et al. | 426/107 |
| 4,914,266 | A | | 4/1990 | Parks et al. | |
| 4,915,216 | A | | 4/1990 | Magers | 206/520 |
| 4,915,780 | A | | 4/1990 | Beckett | |
| 4,919,785 | A | * | 4/1990 | Willey et al. | 229/207 |
| 4,920,251 | A | | 4/1990 | Whitenack et al. | |
| 4,922,079 | A | | 5/1990 | Bowen et al. | |
| 4,923,704 | A | | 5/1990 | Levinson | |
| 4,924,048 | A | | 5/1990 | Bunce et al. | |
| 4,935,592 | A | | 6/1990 | Oppenheimer | |
| 4,939,332 | A | | 7/1990 | Hahn | |
| 4,943,456 | A | | 7/1990 | Pollart et al. | |
| 4,948,932 | A | | 8/1990 | Clough | |
| 4,952,765 | A | | 8/1990 | Toyosawa | |
| 4,959,516 | A | | 9/1990 | Tighe et al. | |
| 4,960,598 | A | | 10/1990 | Swiontek | |
| 4,961,944 | A | | 10/1990 | Matoba et al. | |
| 4,963,708 | A | | 10/1990 | Kearns et al. | |
| D312,189 | S | | 11/1990 | Noel | |
| 4,973,502 | A | | 11/1990 | Holzmüller | 428/35.8 |
| 4,973,810 | A | | 11/1990 | Brauner | |
| 4,982,064 | A | | 1/1991 | Hartman et al. | |
| 4,987,280 | A | | 1/1991 | Kanafani et al. | |
| 4,990,349 | A | | 2/1991 | Chawan et al. | |
| 4,992,638 | A | | 2/1991 | Hewitt et al. | |
| 5,011,299 | A | | 4/1991 | Black, Jr. et al. | 383/126 |
| 5,025,715 | A | | 6/1991 | Sir | |
| 5,026,958 | A | | 6/1991 | Palacios | |
| 5,035,800 | A | | 7/1991 | Kopach | |
| 5,038,009 | A | | 8/1991 | Babbitt | |

(56) References Cited

U.S. PATENT DOCUMENTS

| | | | | |
|---|---|---|---|---|
| 5,039,001 | A | 8/1991 | Kinigakis et al. | 229/120 |
| 5,041,295 | A | 8/1991 | Perry et al. | |
| 5,044,777 | A | 9/1991 | Watkins et al. | 383/100 |
| 5,050,791 | A | 9/1991 | Bowden et al. | |
| 5,052,369 | A | 10/1991 | Johnson | |
| 5,057,331 | A | 10/1991 | Levinson | 426/243 |
| D321,302 | S | 11/1991 | Zimmerman | |
| 5,063,072 | A | 11/1991 | Gillmore et al. | |
| 5,075,526 | A | 12/1991 | Sklenak et al. | |
| 5,077,066 | A | 12/1991 | Mattson et al. | |
| 5,081,330 | A | 1/1992 | Brandberg et al. | |
| 5,094,865 | A | 3/1992 | Levinson | |
| 5,095,186 | A | 3/1992 | Scott Russell et al. | |
| 5,106,635 | A | 4/1992 | McCutchan et al. | |
| 5,107,087 | A | 4/1992 | Yamada et al. | |
| 5,108,768 | A | 4/1992 | So | 426/77 |
| 5,153,402 | A | 10/1992 | Quick et al. | |
| 5,176,284 | A | 1/1993 | Sorensen | 220/659 |
| 5,189,947 | A | 3/1993 | Yim | 426/109 |
| 5,190,777 | A | 3/1993 | Anderson et al. | |
| 5,195,829 | A | 3/1993 | Watkins et al. | 383/100 |
| 5,200,590 | A | 4/1993 | Bowen et al. | |
| D335,445 | S | 5/1993 | Detert et al. | D9/761 |
| D335,821 | S | 5/1993 | Detert et al. | D9/761 |
| D336,242 | S | 6/1993 | Detert et al. | D9/761 |
| 5,223,291 | A | 6/1993 | Levinson et al. | |
| 5,230,914 | A | 7/1993 | Akervik | |
| 5,241,149 | A | 8/1993 | Watanabe et al. | |
| D341,990 | S | 12/1993 | Yim | |
| 5,294,765 | A | 3/1994 | Archibald et al. | 219/727 |
| 5,298,708 | A | 3/1994 | Babu et al. | 219/728 |
| 5,300,747 | A | 4/1994 | Simon | |
| 5,315,083 | A | 5/1994 | Green | |
| 5,330,099 | A * | 7/1994 | Beales et al. | 229/207 |
| 5,363,750 | A | 11/1994 | Miller et al. | 99/426 |
| D353,303 | S | 12/1994 | Davis | |
| 5,370,042 | A | 12/1994 | Tolchin et al. | |
| 5,419,451 | A | 5/1995 | Bitel, Jr. | 220/306 |
| 5,423,449 | A * | 6/1995 | Gordon et al. | 220/23.89 |
| 5,423,453 | A | 6/1995 | Fritz | |
| 5,433,374 | A * | 7/1995 | Forbes, Jr. | 229/125.35 |
| 5,520,301 | A | 5/1996 | Sohn | 220/265 |
| D370,598 | S | 6/1996 | Koch | |
| D371,963 | S | 7/1996 | Ahern, Jr. | |
| 5,540,381 | A | 7/1996 | Davis | |
| 5,558,798 | A | 9/1996 | Tsai | |
| D376,512 | S | 12/1996 | Klemme | D7/538 |
| 5,588,587 | A | 12/1996 | Stier et al. | |
| D378,565 | S | 3/1997 | Cousins | D7/667 |
| D378,566 | S | 3/1997 | Cousins | D7/667 |
| 5,645,300 | A | 7/1997 | Hill | |
| 5,645,762 | A | 7/1997 | Cook et al. | |
| 5,650,084 | A | 7/1997 | Bley | 219/727 |
| D384,555 | S | 10/1997 | Bradley | |
| 5,674,546 | A | 10/1997 | Barnes et al. | |
| D386,042 | S | 11/1997 | Miller | |
| 5,690,853 | A | 11/1997 | Jackson et al. | 219/727 |
| 5,695,801 | A | 12/1997 | Oh | |
| 5,698,306 | A | 12/1997 | Prosise et al. | |
| 5,704,485 | A | 1/1998 | Cautereels et al. | 206/546 |
| 5,718,933 | A | 2/1998 | Fultz | 426/115 |
| D391,440 | S | 3/1998 | Cousins | D7/360 |
| 5,726,426 | A | 3/1998 | Davis et al. | |
| 5,741,534 | A | 4/1998 | Chung | |
| 5,747,086 | A | 5/1998 | Bows et al. | |
| 5,753,895 | A | 5/1998 | Olson et al. | 219/727 |
| 5,770,840 | A | 6/1998 | Lorence | |
| 5,807,597 | A | 9/1998 | Barnes et al. | |
| D405,561 | S | 2/1999 | Willinger et al. | D30/129 |
| 5,866,041 | A | 2/1999 | Svarz et al. | |
| 5,869,120 | A | 2/1999 | Blazevich | 426/132 |
| 5,871,790 | A | 2/1999 | Monier et al. | 426/107 |
| 5,876,811 | A | 3/1999 | Blackwell et al. | |
| 5,900,264 | A | 5/1999 | Gics | |
| 5,913,966 | A | 6/1999 | Arnone et al. | 99/413 |
| 5,916,470 | A | 6/1999 | Besser et al. | |
| 5,916,620 | A | 6/1999 | Oh | |
| 5,925,281 | A | 7/1999 | Levinson | |
| 5,928,554 | A | 7/1999 | Olson et al. | 219/727 |
| 5,931,333 | A | 8/1999 | Woodnorth et al. | |
| 5,961,872 | A | 10/1999 | Simon et al. | |
| 5,970,858 | A | 10/1999 | Boehm et al. | 99/446 |
| 5,974,953 | A | 11/1999 | Messerli | 99/340 |
| 5,986,248 | A | 11/1999 | Matsuno et al. | 219/728 |
| 5,988,045 | A | 11/1999 | Housley | |
| 5,988,050 | A | 11/1999 | Foster, Jr. | 99/467 |
| D418,017 | S | 12/1999 | Henry | |
| D419,371 | S | 1/2000 | Haley | |
| 6,018,157 | A | 1/2000 | Craft | |
| 6,042,856 | A | 3/2000 | Sagan et al. | 426/67 |
| D422,176 | S | 4/2000 | Laib | |
| 6,049,072 | A | 4/2000 | Olson et al. | 219/727 |
| 6,085,930 | A | 7/2000 | Curtis | 220/371 |
| 6,097,017 | A | 8/2000 | Pickford | |
| 6,103,291 | A | 8/2000 | Fernandez Tapia | 426/523 |
| 6,106,882 | A | 8/2000 | Oh et al. | |
| D432,414 | S | 10/2000 | Simpson et al. | D9/711 |
| D432,914 | S | 10/2000 | Hayes et al. | |
| 6,126,976 | A | 10/2000 | Hasse, Jr. et al. | |
| 6,136,355 | A | 10/2000 | Fukuyama | |
| D433,884 | S | 11/2000 | Fujimoto | D7/667 |
| 6,147,337 | A | 11/2000 | Besser | |
| 6,150,646 | A | 11/2000 | Lai et al. | |
| 6,168,044 | B1 | 1/2001 | Zettle et al. | 220/784 |
| 6,175,105 | B1 | 1/2001 | Rubbright et al. | |
| 6,180,148 | B1 | 1/2001 | Yajima | |
| 6,180,150 | B1 | 1/2001 | Schäfer | |
| 6,183,789 | B1 | 2/2001 | Nilsson et al. | |
| 6,187,354 | B1 | 2/2001 | Hopkins | |
| 6,192,792 | B1 | 2/2001 | Gremillion | |
| 6,196,406 | B1 | 3/2001 | Ennis | |
| 6,217,918 | B1 | 4/2001 | Oh et al. | |
| D441,597 | S | 5/2001 | Wyche | |
| D442,425 | S | 5/2001 | Wyche | |
| 6,229,131 | B1 | 5/2001 | Koochaki | |
| 6,230,919 | B1 | 5/2001 | Guillin | 220/315 |
| D445,633 | S | 7/2001 | Bradley | |
| D449,102 | S | 10/2001 | Shin | D23/366 |
| D449,495 | S | 10/2001 | Tucker et al. | |
| 6,309,684 | B2 | 10/2001 | Hopkins, Sr. | 426/234 |
| 6,394,337 | B1 | 5/2002 | Ross et al. | |
| 6,396,036 | B1 | 5/2002 | Hanson | 219/727 |
| 6,422,453 | B1 | 7/2002 | Wang | |
| 6,455,084 | B2 | 9/2002 | Johns | |
| 6,463,844 | B1 | 10/2002 | Wang et al. | |
| 6,467,399 | B1 | 10/2002 | Boutte | |
| 6,486,455 | B1 | 11/2002 | Merabet | |
| D466,762 | S | 12/2002 | Cote et al. | D7/545 |
| 6,509,047 | B2 | 1/2003 | Edomwonyi | |
| D470,768 | S | 2/2003 | Melhede | D9/428 |
| 6,559,431 | B2 | 5/2003 | Hopkins | 219/735 |
| 6,565,910 | B1 | 5/2003 | Schell et al. | 426/589 |
| D477,187 | S | 7/2003 | McCallister et al. | |
| 6,608,292 | B1 | 8/2003 | Barnes | |
| 6,612,482 | B2 | 9/2003 | Ross | |
| 6,645,539 | B2 | 11/2003 | Bukowski et al. | |
| D483,616 | S | 12/2003 | Thonis | |
| D485,473 | S | 1/2004 | Dais et al. | D7/629 |
| 6,727,484 | B2 | 4/2004 | Policappelli | |
| 6,803,551 | B2 | 10/2004 | Kim et al. | 219/731 |
| D497,774 | S | 11/2004 | Smith et al. | D7/543 |
| 6,818,873 | B2 | 11/2004 | Savage et al. | |
| 6,840,159 | B1 | 1/2005 | Li | 99/337 |
| D502,847 | S | 3/2005 | Leonori | D7/667 |
| 6,868,980 | B2 | 3/2005 | Schultz et al. | |
| D505,048 | S | 5/2005 | Cornfield | D7/409 |
| D505,590 | S | 5/2005 | Greiner et al. | D7/409 |
| D508,822 | S | 8/2005 | Smith et al. | |
| D513,942 | S | 1/2006 | De Groote | D7/665 |
| 7,008,214 | B2 | 3/2006 | Faddi | 425/382 R |
| 7,022,359 | B2 | 4/2006 | Montserrate Gibernau | |
| 7,025,213 | B2 | 4/2006 | Chen | 210/474 |

(56) References Cited

U.S. PATENT DOCUMENTS

| | | | | |
|---|---|---|---|---|
| D521,380 | S | 5/2006 | Jackson et al. | |
| 7,038,181 | B2 | 5/2006 | Edmark | |
| 7,045,190 | B2 | 5/2006 | Inagaki et al. | |
| D526,840 | S | 8/2006 | Carlson | |
| 7,090,090 | B2 | 8/2006 | Ohyama | |
| D529,797 | S | 10/2006 | Wilcox et al. | D9/428 |
| D543,796 | S | 6/2007 | Lion et al. | D7/667 |
| D552,433 | S | 10/2007 | Stewart | D7/667 |
| D557,982 | S | 12/2007 | Ablo | D7/409 |
| D558,536 | S | 1/2008 | Curtin | D7/667 |
| D558,602 | S | 1/2008 | Kissner et al. | D9/711 |
| D563,157 | S | 3/2008 | Bouveret et al. | |
| D564,287 | S | 3/2008 | Bouveret et al. | |
| D564,307 | S | 3/2008 | Repp | D7/667 |
| D571,656 | S | 6/2008 | Maslowski | D9/425 |
| D577,295 | S | 9/2008 | Miller et al. | D9/711 |
| D582,201 | S | 12/2008 | Kellerman et al. | |
| D582,791 | S | 12/2008 | Elmerhaus | D9/721 |
| 7,468,498 | B2 | 12/2008 | Tuszkiewicz et al. | 219/725 |
| D584,111 | S | 1/2009 | Eide et al. | D7/667 |
| D584,145 | S | 1/2009 | Young | |
| D590,663 | S | 4/2009 | Simon et al. | |
| D591,591 | S | 5/2009 | Moecks et al. | |
| D592,948 | S | 5/2009 | Mayer | D9/418 |
| D593,369 | S | 6/2009 | Green et al. | D9/428 |
| D594,328 | S | 6/2009 | Shapiro et al. | D9/435 |
| D598,717 | S | 8/2009 | Jalet | D7/667 |
| D607,095 | S | 12/2009 | LeMay et al. | D23/366 |
| D610,903 | S | 3/2010 | Shapiro et al. | D9/428 |
| D611,300 | S | 3/2010 | Chen et al. | D7/409 |
| D612,196 | S | 3/2010 | Furlong | |
| D613,131 | S | 4/2010 | Chen et al. | D7/667 |
| D630,061 | S | 1/2011 | Kellerman et al. | |
| D630,507 | S | 1/2011 | Short et al. | D9/427 |
| D630,940 | S | 1/2011 | Shapiro et al. | D9/428 |
| D632,561 | S | 2/2011 | Short et al. | D9/427 |
| D633,810 | S | 3/2011 | Jenkins | D9/721 |
| D635,816 | S | 4/2011 | France et al. | D7/354 |
| D635,817 | S | 4/2011 | France et al. | D7/354 |
| D636,218 | S | 4/2011 | France et al. | D7/354 |
| 7,977,612 | B2 | 7/2011 | Levy et al. | 219/729 |
| 8,015,780 | B2 * | 9/2011 | Cook et al. | 53/491 |
| D653,495 | S | 2/2012 | France et al. | D7/354 |
| 2001/0035402 | A1 | 11/2001 | Barrow | 219/432 |
| 2001/0043971 | A1 | 11/2001 | Johns | |
| 2001/0050002 | A1 | 12/2001 | Bonanno | |
| 2002/0096450 | A1 | 7/2002 | Garst | 206/516 |
| 2002/0110622 | A1 | 8/2002 | Lloyd et al. | 426/115 |
| 2003/0003200 | A1 | 1/2003 | Bukowski et al. | |
| 2003/0068411 | A1 | 4/2003 | McCallister et al. | 426/107 |
| 2003/0167932 | A1 | 9/2003 | Chen | |
| 2003/0213718 | A1 | 11/2003 | Ducharme et al. | |
| 2004/0058038 | A1 | 3/2004 | Lee | 426/107 |
| 2004/0094611 | A1 * | 5/2004 | van Eijndhoven et al. | 229/125.35 |
| 2004/0107637 | A1 | 6/2004 | Sieverding | 47/83 |
| 2004/0121049 | A1 | 6/2004 | Ebner et al. | |
| 2004/0164075 | A1 | 8/2004 | Henze et al. | 219/740 |
| 2004/0216620 | A1 | 11/2004 | Quiggins et al. | |
| 2004/0238438 | A1 | 12/2004 | Chen | 210/474 |
| 2005/0040161 | A1 | 2/2005 | Lin et al. | |
| 2005/0051549 | A1 | 3/2005 | Nelson | |
| 2005/0069602 | A1 | 3/2005 | Faddi | 425/208 |
| 2005/0079250 | A1 | 4/2005 | Mao et al. | 426/113 |
| 2005/0079252 | A1 | 4/2005 | Kendig et al. | 426/125 |
| 2005/0082305 | A1 | 4/2005 | Dais et al. | |
| 2005/0092762 | A1 | 5/2005 | Murat et al. | |
| 2005/0109772 | A1 | 5/2005 | Thorpe et al. | |
| 2005/0112243 | A1 | 5/2005 | Bellmann et al. | 426/106 |
| 2005/0115417 | A1 | 6/2005 | Murat et al. | 99/413 |
| 2005/0208182 | A1 | 9/2005 | Gilbert et al. | 426/87 |
| 2005/0220939 | A1 | 10/2005 | Morrow | 426/86 |
| 2005/0229793 | A1 | 10/2005 | Wengrovsky | 99/483 |
| 2005/0256060 | A1 | 11/2005 | Hilgers et al. | 514/25 |
| 2005/0271776 | A1 | 12/2005 | Siegel | 426/138 |
| 2005/0281921 | A1 | 12/2005 | Langston et al. | |
| 2006/0013929 | A1 | 1/2006 | Morris et al. | |
| 2006/0088678 | A1 | 4/2006 | Berrier et al. | |
| 2006/0110498 | A1 | 5/2006 | Dellinger et al. | |
| 2006/0118552 | A1 | 6/2006 | Tiefenback | |
| 2006/0121168 | A1 | 6/2006 | Flaherty et al. | |
| 2006/0151339 | A1 | 7/2006 | Bradley et al. | |
| 2006/0236593 | A1 | 10/2006 | Cap | |
| 2006/0260598 | A1 | 11/2006 | Bjork et al. | |
| 2006/0289522 | A1 | 12/2006 | Middleton et al. | 219/730 |
| 2007/0029314 | A1 | 2/2007 | Rodgers et al. | |
| 2007/0059406 | A1 | 3/2007 | Shahsavarani | 426/106 |
| 2007/0090103 | A1 | 4/2007 | France et al. | 219/400 |
| 2007/0116806 | A1 | 5/2007 | Parsons | 426/107 |
| 2007/0116807 | A1 | 5/2007 | Parsons | 426/107 |
| 2007/0131679 | A1 | 6/2007 | Edwards et al. | |
| 2007/0181008 | A1 | 8/2007 | Pawlick et al. | 99/450 |
| 2007/0251874 | A1 | 11/2007 | Stewart | 210/232 |
| 2008/0069485 | A1 | 3/2008 | France et al. | |
| 2008/0138473 | A1 | 6/2008 | Pawlick et al. | |
| 2008/0178744 | A1 | 7/2008 | Hill | |
| 2008/0210686 | A1 | 9/2008 | Shapiro et al. | |
| 2009/0022858 | A1 | 1/2009 | Pawlick | |
| 2009/0035433 | A1 | 2/2009 | France et al. | 426/510 |
| 2009/0078125 | A1 | 3/2009 | Pawlick et al. | 99/448 |
| 2009/0142455 | A1 | 6/2009 | Parsons | 426/120 |
| 2010/0015293 | A1 | 1/2010 | Shapiro | |

FOREIGN PATENT DOCUMENTS

| | | | |
|---|---|---|---|
| EP | 0326105 | A1 | 8/1989 |
| EP | 0 449 643 | A1 | 10/1991 |
| EP | 1 245 504 | A1 | 10/2002 |
| EP | 1 352 841 | A1 | 10/2003 |
| EP | 1 352 848 | A1 | 10/2003 |
| EP | 1 514 804 | A1 | 3/2005 |
| EP | 1 464 262 | B1 | 7/2005 |
| EP | 1 612 150 | A1 | 1/2006 |
| EP | 1 749 757 | A2 | 2/2007 |
| FR | 2 631 315 | A3 | 11/1989 |
| FR | 2 774 262 | A1 | 8/1999 |
| FR | 2 846 196 | A1 | 4/2004 |
| FR | 2 860 213 | | 4/2005 |
| FR | 2 929 491 | | 10/2009 |
| GB | 1 560 488 | | 2/1980 |
| GB | 2 218 962 | A | 11/1989 |
| GB | 2 295 371 | A | 5/1996 |
| GB | 2 308 465 | A | 6/1997 |
| GB | 2 340 823 | A | 3/2000 |
| JP | 2-109882 | | 4/1990 |
| JP | 4367476 | A | 12/1992 |
| JP | 06293366 | | 10/1994 |
| JP | 09051767 | | 2/1997 |
| JP | 10094370 | A | 4/1998 |
| JP | 10-129742 | | 5/1998 |
| JP | 11113511 | | 4/1999 |
| JP | 2001348074 | A | 12/2001 |
| JP | 2005059863 | A | 3/2005 |
| JP | 2005-312923 | | 11/2005 |
| JP | 2006-034645 | | 2/2006 |
| JP | 2010-189031 | | 9/2010 |
| MX | 01011879 | A | 6/2002 |
| SU | 1149999 | A | 4/1985 |
| WO | WO 86/00275 | | 1/1986 |
| WO | WO 96/07604 | | 3/1996 |
| WO | WO 98/33399 | | 8/1998 |
| WO | WO 99/59897 | | 11/1999 |
| WO | WO 02/051716 | | 7/2002 |
| WO | WO 03/086882 | A1 | 10/2003 |
| WO | WO 2004/045970 | A1 | 6/2004 |
| WO | WO 2006/098950 | A2 | 9/2006 |
| WO | WO 2006/128156 | A2 | 11/2006 |
| WO | WO 2006/136825 | A1 | 12/2006 |
| WO | WO 2007/003864 | A2 | 1/2007 |
| WO | WO 2008/109448 | A2 | 9/2008 |

(56) References Cited

FOREIGN PATENT DOCUMENTS

| | | | |
|---|---|---|---|
| WO | WO 2008/109448 | A3 | 9/2008 |
| WO | WO 2009/097030 | A1 | 8/2009 |
| WO | WO 2009/136038 | A1 | 11/2009 |

OTHER PUBLICATIONS

U.S. Official Action Mailed Jan. 16, 2014, in U.S. Appl. No. 12/277,886.
U.S. Official Action Mailed Jan. 16, 2014, in U.S. Appl. No. 11/286,008.
U.S. Official Action Mailed Jan. 22, 2014, in U.S. Appl. No. 12/471,114.
U.S. Official Action Mailed Jan. 29, 2014, in U.S. Apl. No. 12/040,641.
U.S. Official Action mailed Jul. 3, 2013, in U.S. Appl. No. 11/286,008.
U.S. Official Action mailed Aug. 21, 2013, in U.S. Appl. No. 11/890,297.
U.S. Notice of Allowance and Fee Due Mailed Nov. 30, 2012 in U.S. Appl. No. 29/424,416.
"Propylene Glycol Monostearate"; *Hawley's Condensed Chemical Dictionary Thirteenth Edition*; 1997.
U.S. Official Action mailed Jan. 24, 2013, in U.S. Appl. No. 12/471,114.
U.S. Official Action mailed Oct. 3, 2013, in U.S. Appl. No. 11/703,066.
U.S. Official Action mailed Sep. 27, 2013, in U.S. Appl. No. 11/423,259.
U.S. Official Action mailed Sep. 19, 2013, in U.S. Appl. No. 12/471,114.
McCallister, "Microwaveable Pasta Product," U.S. Appl. No. 09/965,300, filed Sep. 28, 2001.
"Cafe Steamers," HealthyChoice.com, http://www.healthychoice.com/products/meals/cafe_steamers.jsp (Retrieved Aug. 2007), 1 pg.
"Ziploc® Containers With Snap'n'Seal Lids: Designed With You in Mind," brochure found at http://www.ziploc.com/food-storage-containers/, (Retrieved Nov. 14, 2005), 2 pgs.
"Ziploc® Containers With Snap'n'Seal Lids: Storage Made Simpler!," brochure found at http://www.ziploc.com/new_containers.html, (Retrieved Nov. 14, 2005), 1 pg.
Anchor Hocking '70 Catalog, p. 83, baking dishes at #4, 5 and 6 (Oct. 1970), 1 pg.
Photographs of a food tray available from Inter Frost GmbH at a trade show in Germany, Oct. 2005, 3 pgs.
http://www.unclebens.de/produkte/heiss_auf_reis/heiss_auf_reis_uebersicht.aspx, Mars Inc., 2006, 1 pg.
http://www.pasanmoresale.com, site accessed Jun. 15, 2015, 2 pgs. (now being sold at http://pastaboat.com).
Starmaid Microwave Steamer Jun. 26, 2006, [on line], retrieved on Oct. 13, 2011. Retrieved from the Internet: URL:<http://www.flickr.com/photos/starmaid/5180282532/>.
Progressive International Mini Steamer (on line), Jul. 18, 2006/ Retrieved from the Internet at the URL listed in the column immediately following this column.
http://www.google.com/search?q=microwave+steamer&hl=en&blw=1291&bih=1015&sa=X&ei=0ZuXT1qGMKbt0gGMyoHWBA&ved=0CAkOpwUoBg&source=Int&tbs=cdr%3A1%2Cod_min%3A2Ccd_max%3A8%2F2007&tbm=#pq=microwave+steamer&hl=en&sugexp=gsih&cp=12&gs_Id=9&xhr=t&q=microwave+mini+steamer&pf=p&sclient=psy-ab&blw=1291&blh=1015&tbs=Img:1%2Ccdr%3A1%2Ccd_max%3A8%2F2%2F2006&.
Mini Steamer—Progessive International / Starmaid vegetable steamer, [on line], retrieved Oct. 21, 2011. retrieved from the Internet: URL:<http://www.campingcookwarepro.com/Progressive_International_Microwavable_Mini_Steamer>.
Tupperware India, Cook easy Microsteamer, The Hindu Business Line, [on line], Jun. 26, 2003, retrieved on Oct. 21, 2011. Retrieved from the Internet: URL:<http://www.thehindubusinessline.in/catalyst/2003/06/26/stories/2006062600070406.htm>.
Microwave mini steamer, Lunch in a Box, [on line] Feb. 12, 2007, retrieved on Oct. 13, 2011. Retrieved from the Internet: URL:<http://www.flickr.com/photos/24506652@N00/388209604/>.
Microwave steamer 2, Oct. 16, 2006, [on line]. Retrieved from the Internet: URL:<http://www.flickr.com/photos/momsinmind/27110248/>.
Succinylated Monoglycerides; http://www.fao.org/ag/agn/jecfa-additives/specs/Monograph1/Additive-443.pdf; 1982; obtained Sep. 14, 2012.
U.S. Official Action Mailed Mar. 21, 2014, in U.S. Appl. No. 11/703,066.
U.S. Official Action Mailed Apr. 14, 2014, in U.S. Appl. No. 11/423,259.
U.S. Official Action Mailed Apr. 21, 2014, in U.S. Appl. No. 11/424,520.
U.S. Official Action Mailed Jun. 16, 2014, in U.S. Appl. No. 12/277,886.

* cited by examiner

CONTAINER ASSEMBLY AND FOLDABLE CONTAINER SYSTEM

BACKGROUND

Various types of packaging can be used to enclose products for distribution, storage, sale, and use. A carton is a type of packaging typically used for products such as food, pharmaceuticals, hardware, and so forth. Folding cartons can be provided by a manufacturer and shipped flat (knocked down) to a packager. For example, tray style cartons often have a solid bottom and are shipped as flat blanks for assembly by a packager. High-speed equipment can be used to erect, fill, and close the cartons.

SUMMARY

Container assemblies are described that include a first container and a second container, where the second container extends into and is supported by the first container. The first container defines an interior volume with an access opening that provides access to the interior volume. The second container also defines an interior volume with an access opening that provides access to the interior volume. The first container can include a flange that extends at least partially around the periphery of its access opening. The second container can also include a flange that extends at least partially around the periphery of its access opening. The flange of the second container is configured to provide support for the second container via engagement with the flange of the first container.

The access opening that provides access to the interior volume of the first container can define an area greater than an area defined by the access opening that provides access to the interior volume of the second container. In this manner, the second container can extend into and be supported by the first container through engagement of the flange of the second container with the flange of the first container such that one or more of the side panels of the first container are not in contact with corresponding side panels of the second container. In implementations, the flange of the first container can define one or more recessed portions of a flange, and the flange of the second container can define one or more corresponding protruding flange portions (e.g., to facilitate removal of the second container from the first container).

The container assembly can also include a lid for retaining the second container in the first container and/or for sealing to the first container and/or the second container. The lid can include an access feature for opening the container assembly to access the interior volume of the first container and/or the second container, and/or to remove the second container from the first container. For example, the lid can include a tear-away opening portion and a tab extending from the tear-away opening portion. A user can grasp and pull the tab to fully or partially remove the tear-away opening portion to access the interior volume of the first container and/or the second container, and/or to remove the second container from the first container (e.g., using a protruding flange portion).

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The Detailed Description is described with reference to the accompanying figures. The use of the same reference numbers in different instances in the description and the figures can indicate similar or identical items.

Figure 9:
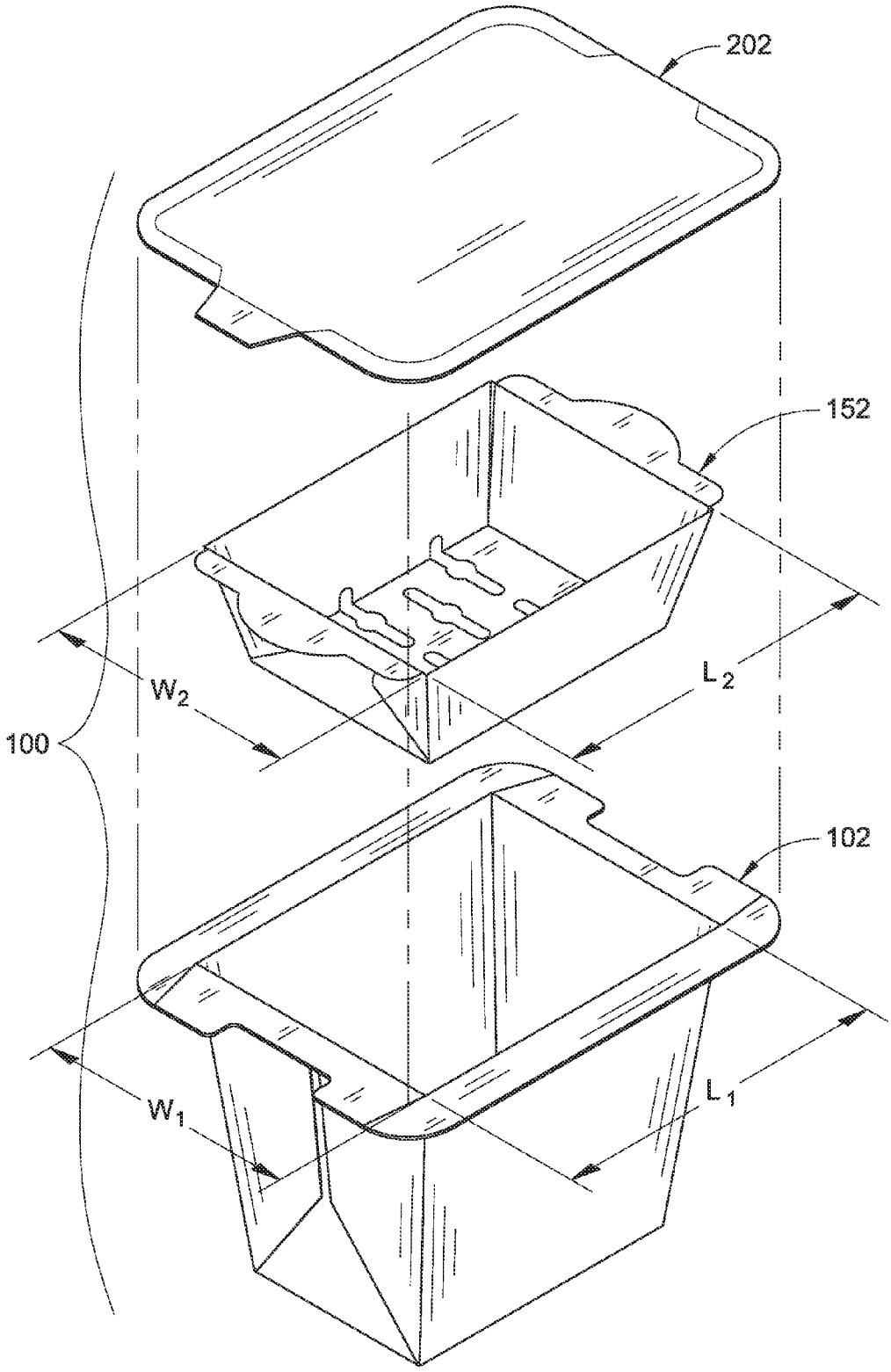

FIG. 9 is an exploded isometric view illustrating a container assembly including a first container, a second container, and a lid, where the second container extends into and is supported by the first container, and the lid retains the second container in the first container and includes an access feature for opening the container assembly to remove the second container from the first container in accordance with example implementations of the present disclosure.

Figure 10:
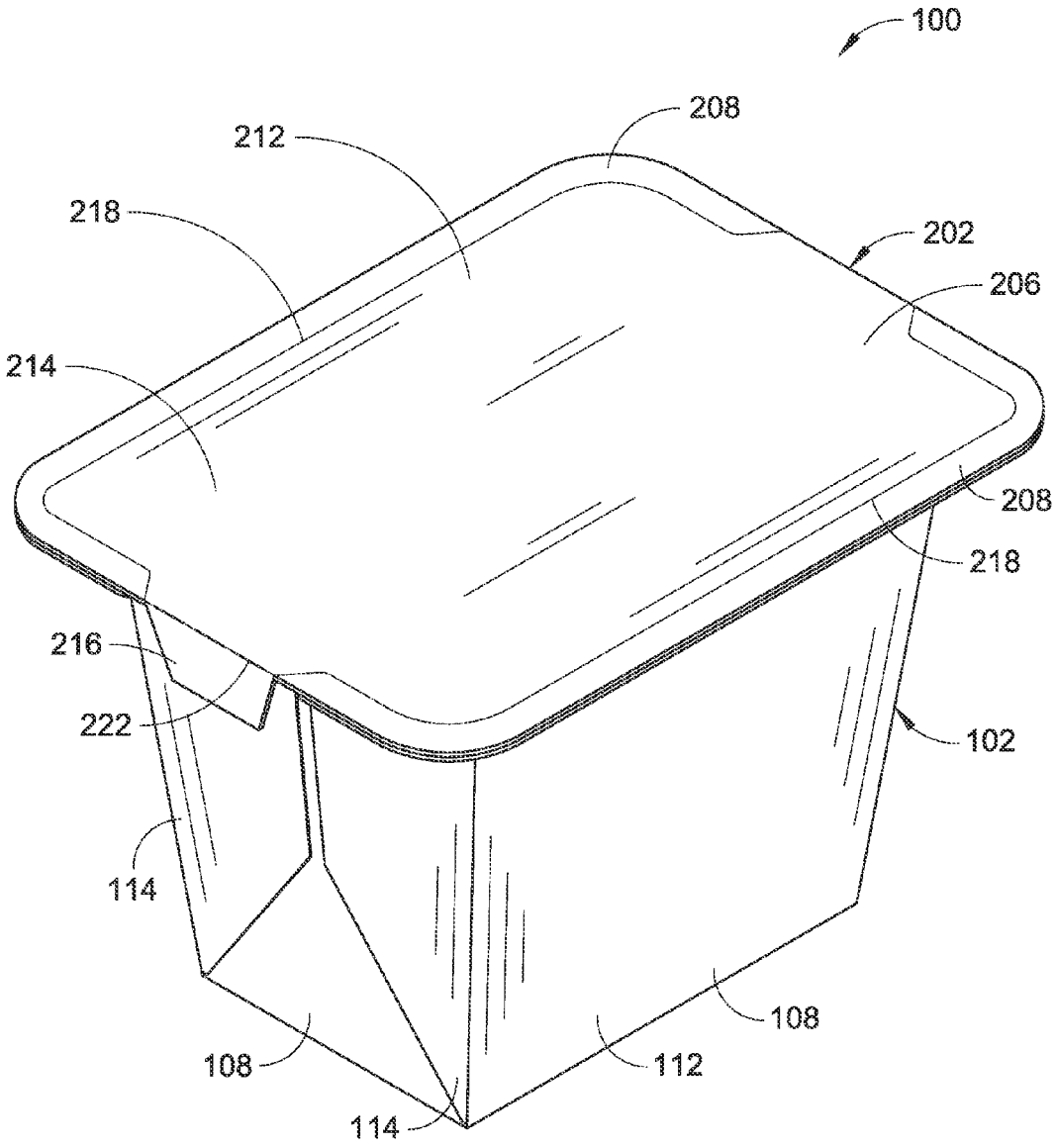

FIG. 10 is an isometric view of the container assembly illustrated in FIG. 9, where the container assembly is assembled.

Figure 11:
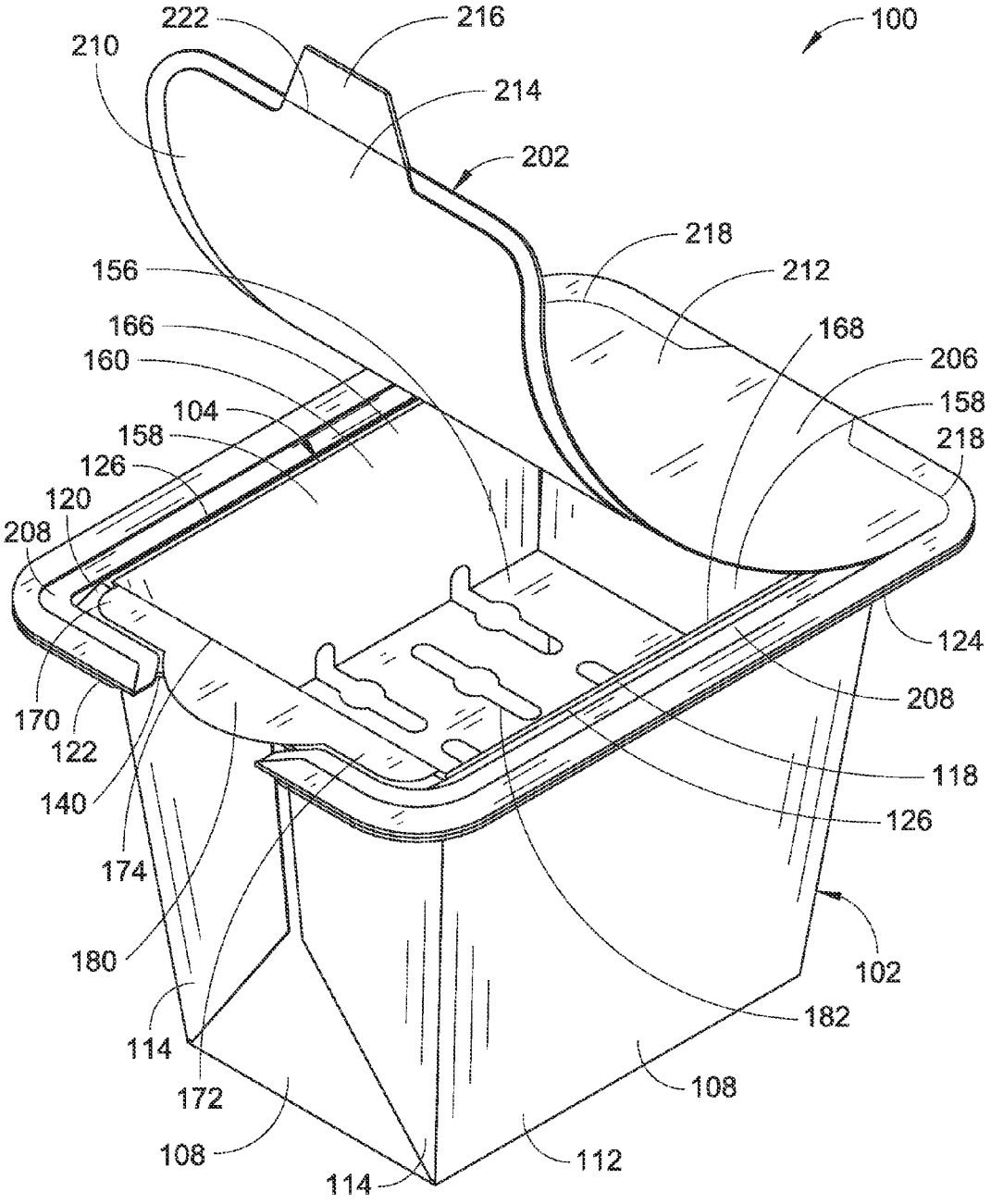

FIG. 11 is another isometric view of the container assembly illustrated in FIG. 9, where the container assembly is assembled, and the lid is partially removed.

Figure 1:
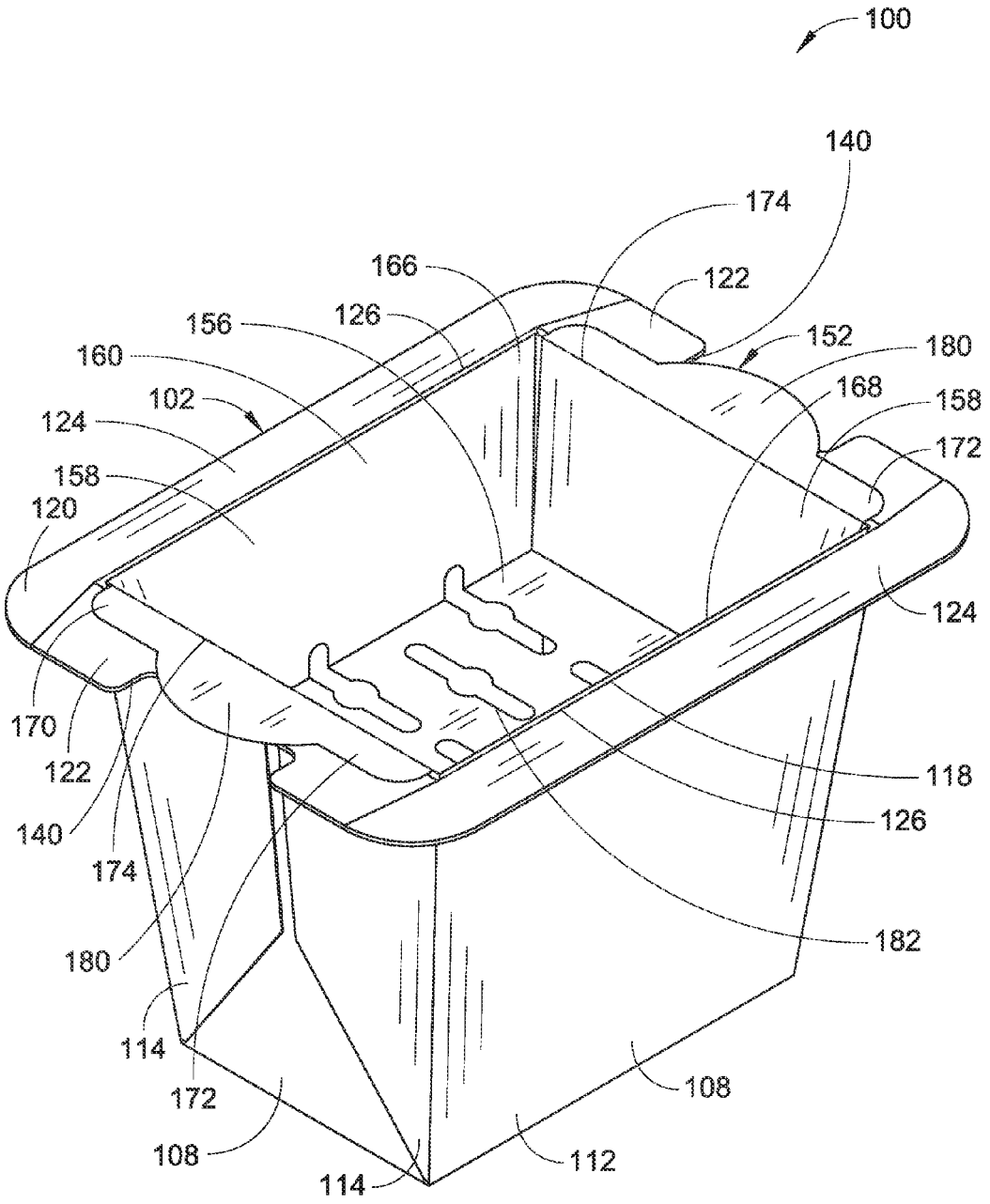
FIG. 1 is an isometric view illustrating a container assembly including a first container and a second container, where the second container extends into and is supported by the first container in accordance with example implementations of the present disclosure.
Figure 2:
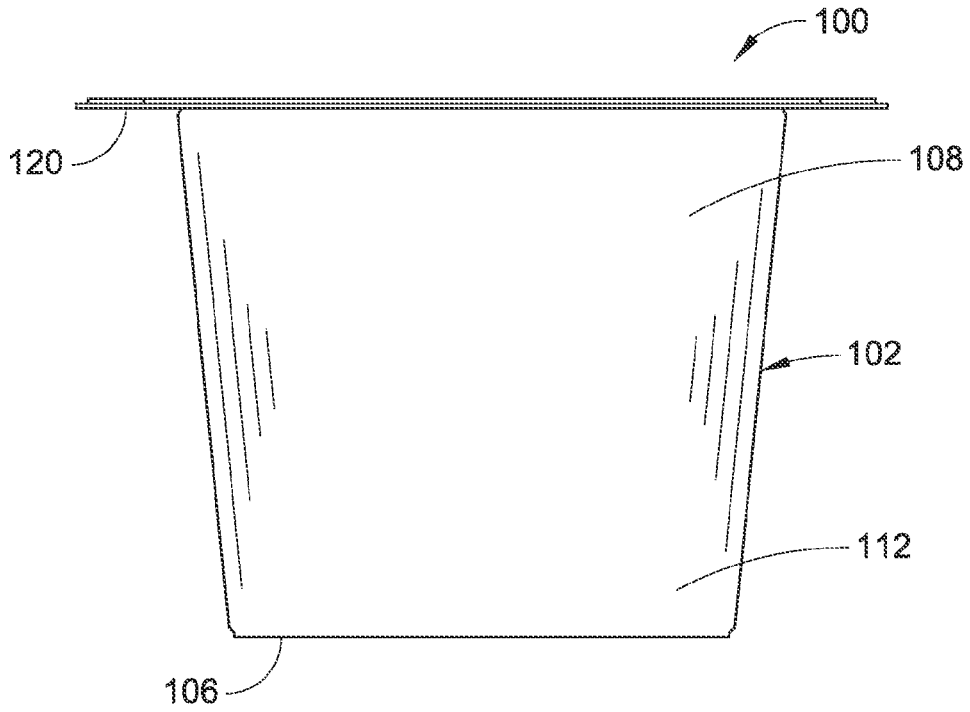
FIG. 2 is a side elevation view of the container assembly illustrated in FIG. 1.
Figure 3:
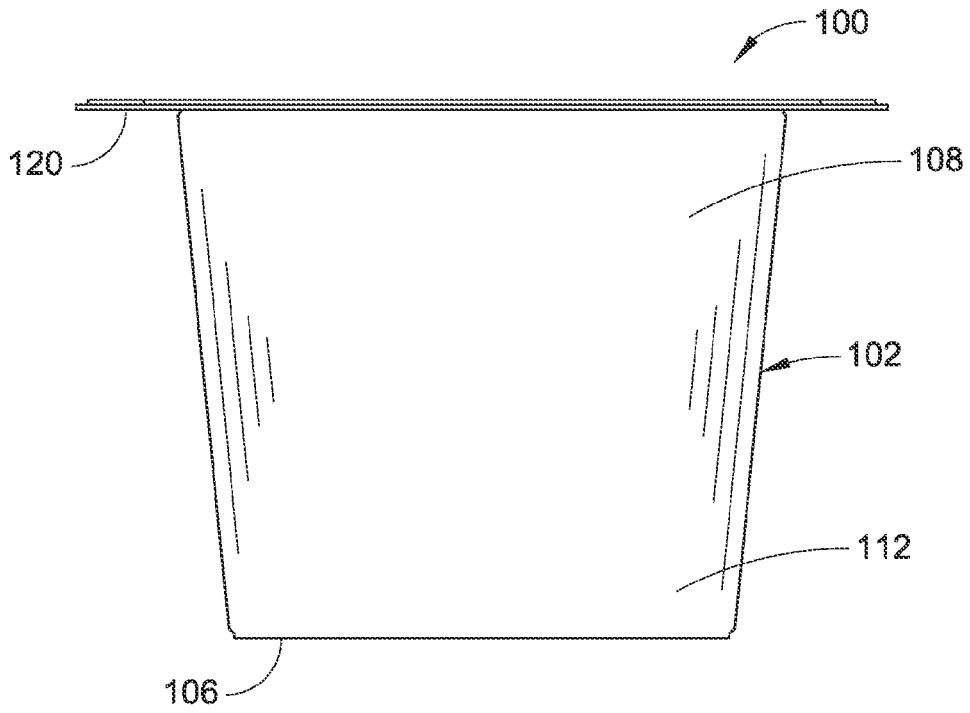
FIG. 3 is another side elevation view of the container assembly illustrated in FIG. 1.
Figure 4:
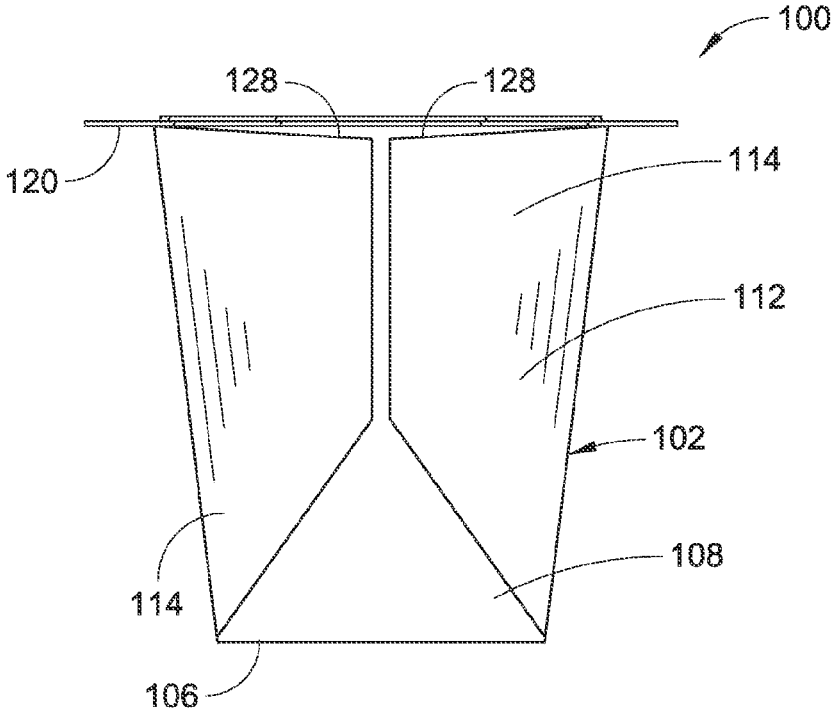
FIG. 4 is an end elevation view of the container assembly illustrated in FIG. 1.
Figure 5:
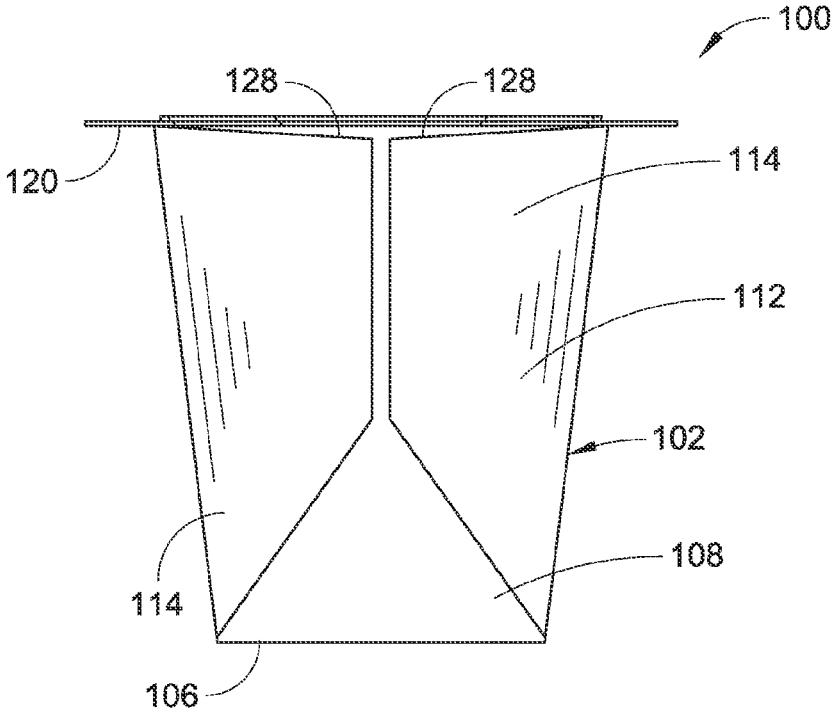
FIG. 5 is another end elevation view of the container assembly illustrated in FIG. 1.
Figure 6:
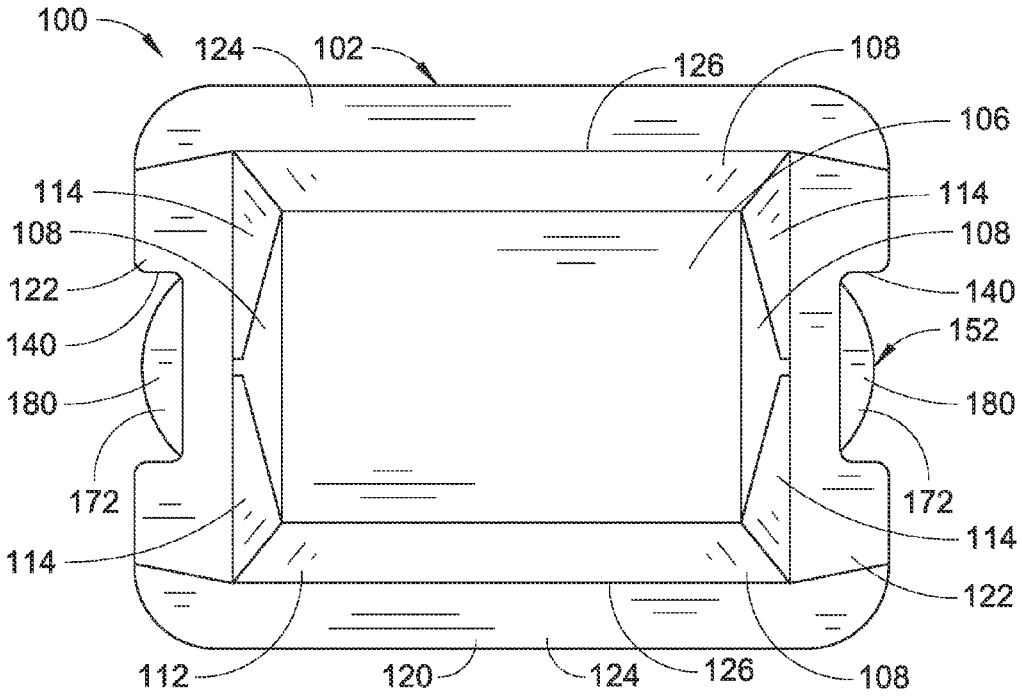
FIG. 6 is a bottom plan view of the container assembly illustrated in FIG. 1.
Figure 7:
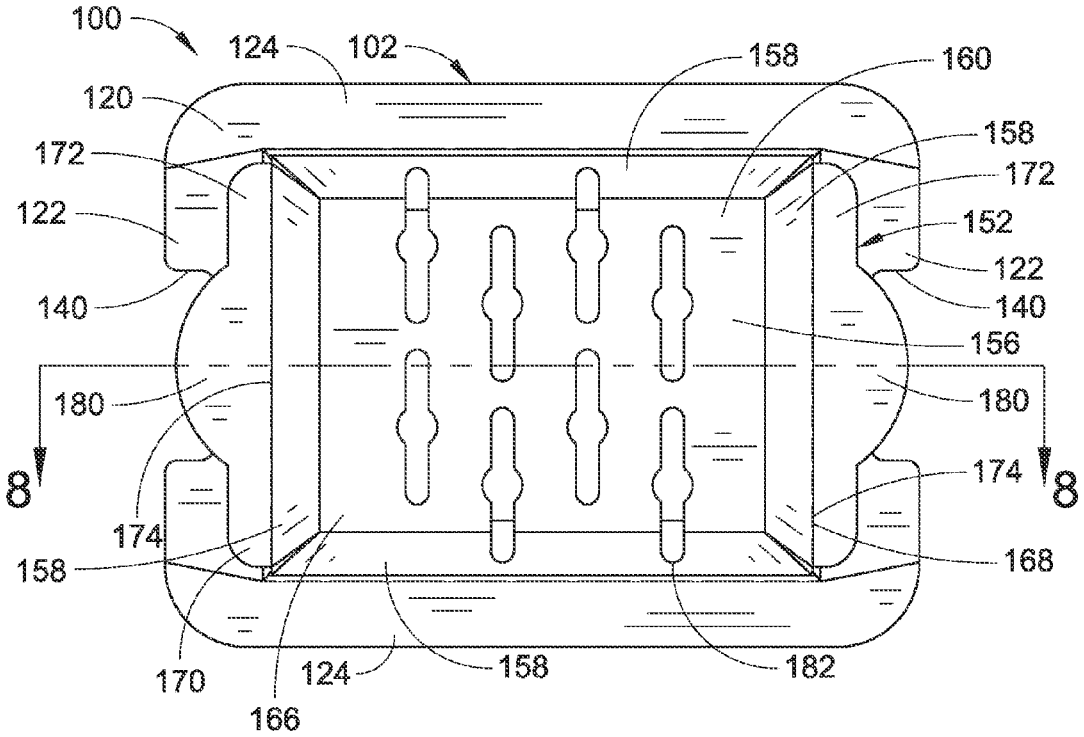
FIG. 7 is a top plan view of the container assembly illustrated in FIG. 1.
Figure 8:
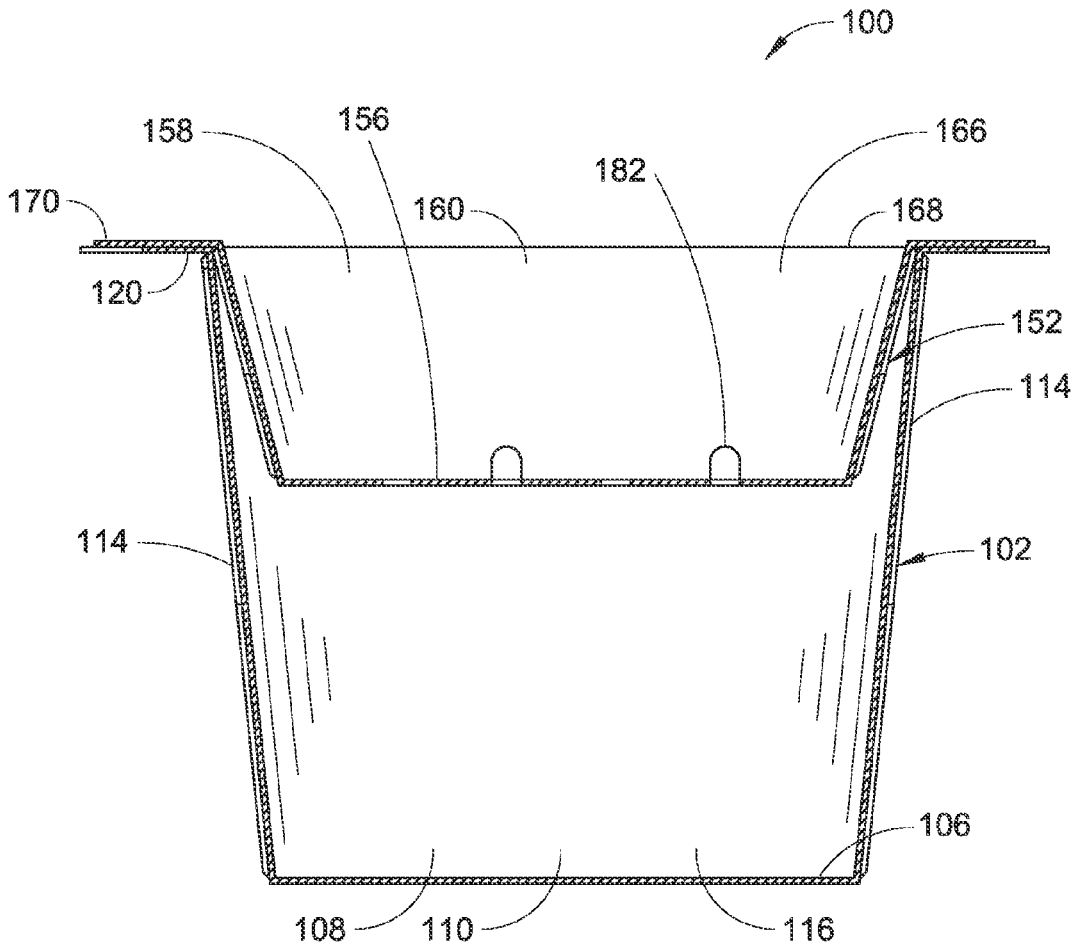
FIG. 8 is a cross-sectional side elevation view of the container assembly illustrated in FIG. 1.
Figure 12A:
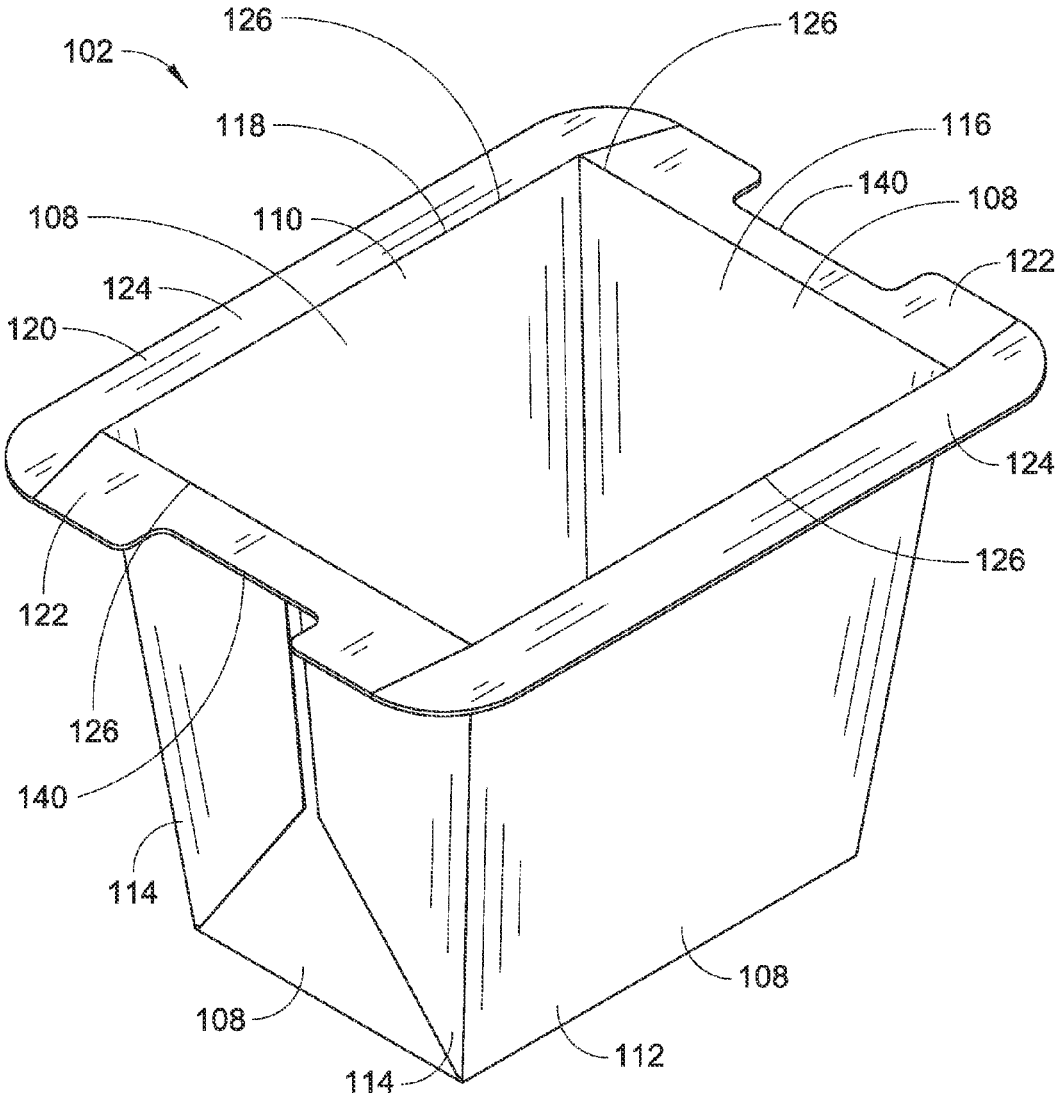

FIG. 12A is an isometric view illustrating a tray for a container assembly, such as the container assembly illustrated in FIGS. 1 and 9 in accordance with example implementations of the present disclosure.

Figure 12B:
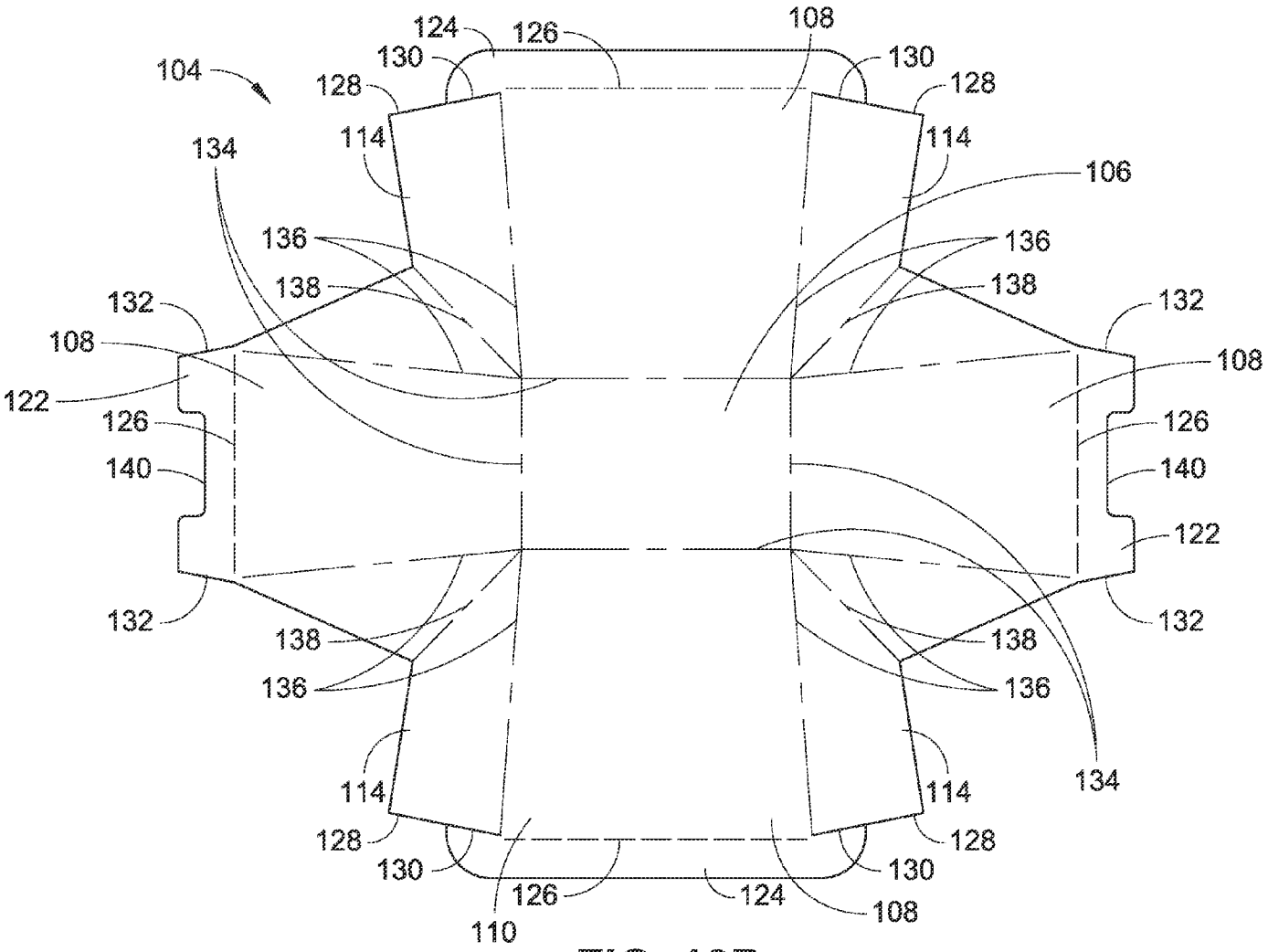

FIG. 12B is a top plan view illustrating a blank for constructing a tray, such as the tray illustrated in FIG. 12A, in accordance with example implementations of the present disclosure.

Figure 13A:
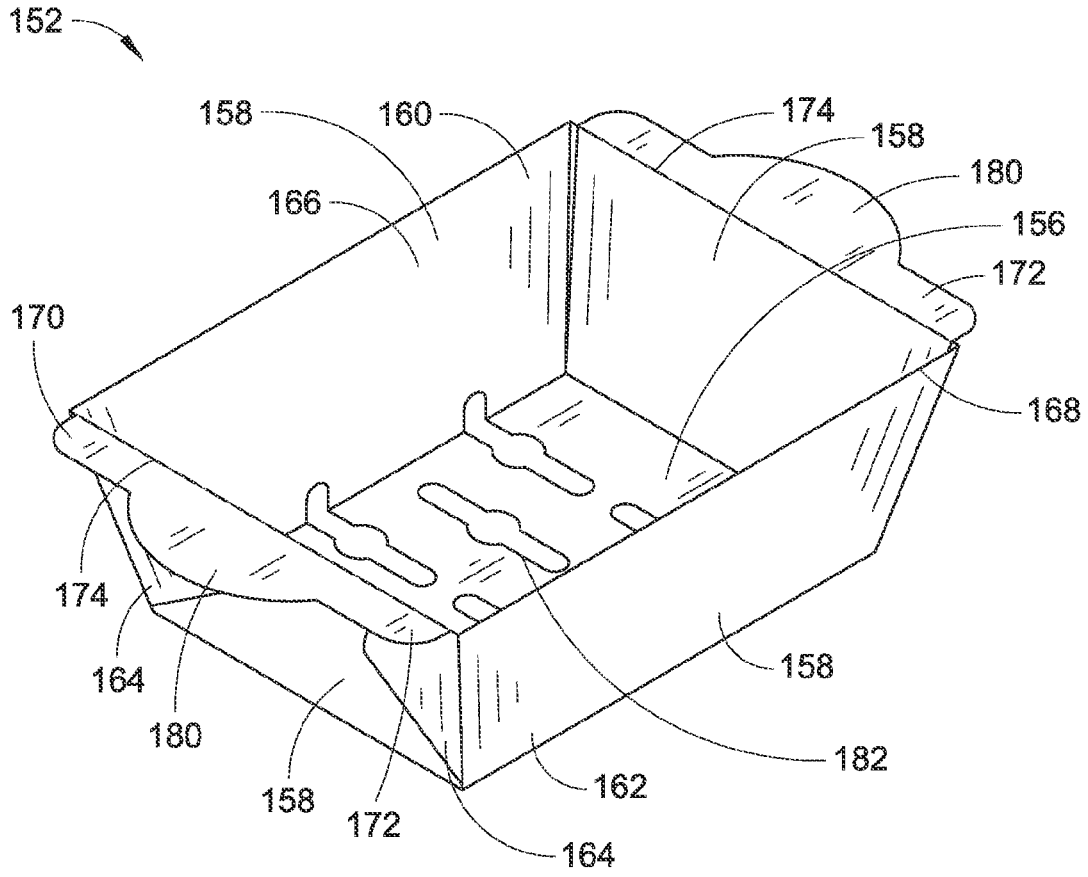

FIG. 13A is an isometric view illustrating a basket for a container assembly, such as the container assembly illustrated in FIGS. 1 and 9 in accordance with example implementations of the present disclosure.

Figure 13B:
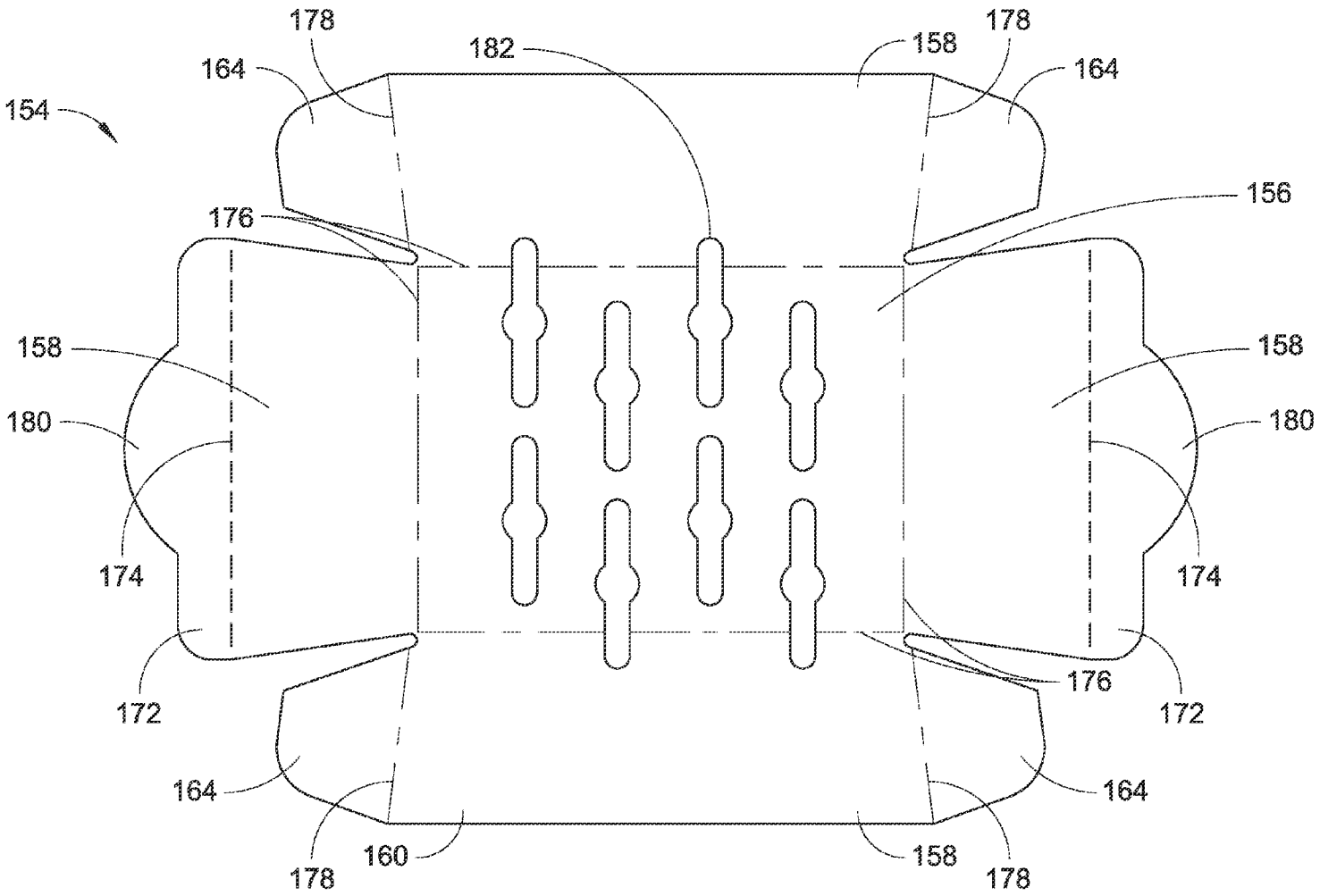

FIG. 13B is a top plan view illustrating a blank for constructing a basket, such as the basket illustrated in FIG. 13A, in accordance with example implementations of the present disclosure.

Figure 14A:
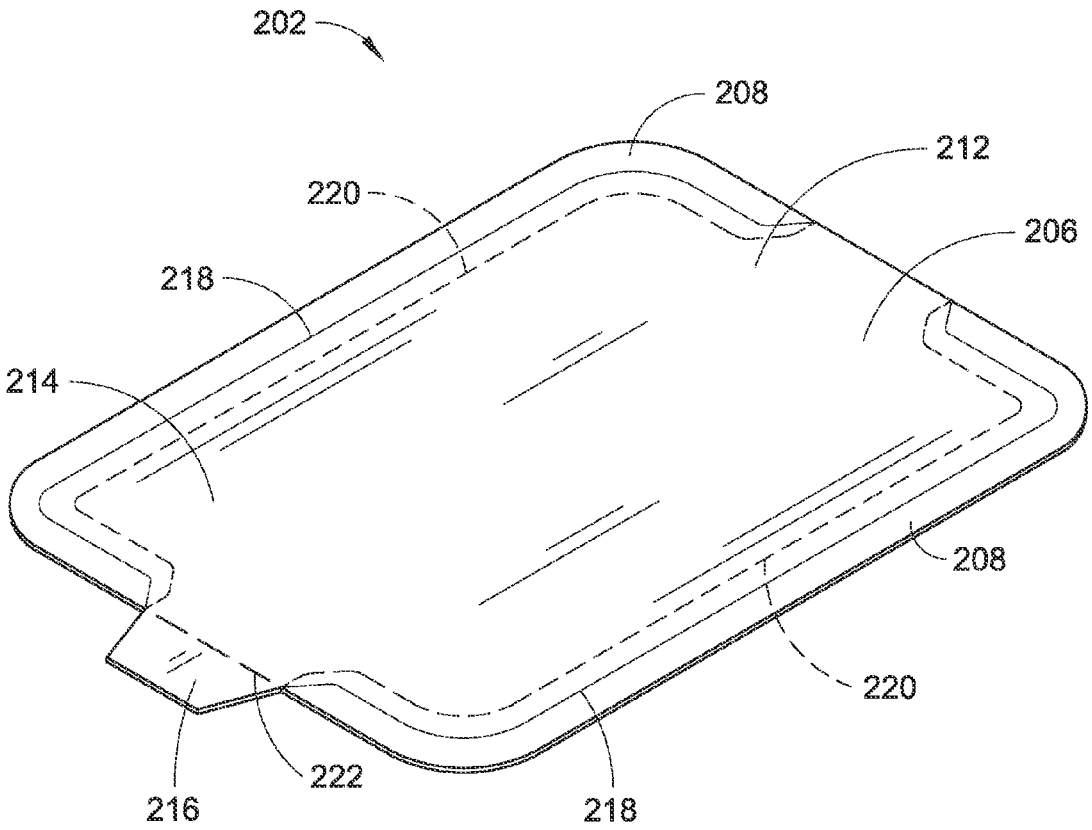

FIG. 14A is an isometric view illustrating a lid for a container assembly, such as the container assembly illustrated in FIGS. 1 and 9 in accordance with example implementations of the present disclosure.

Figure 14B:
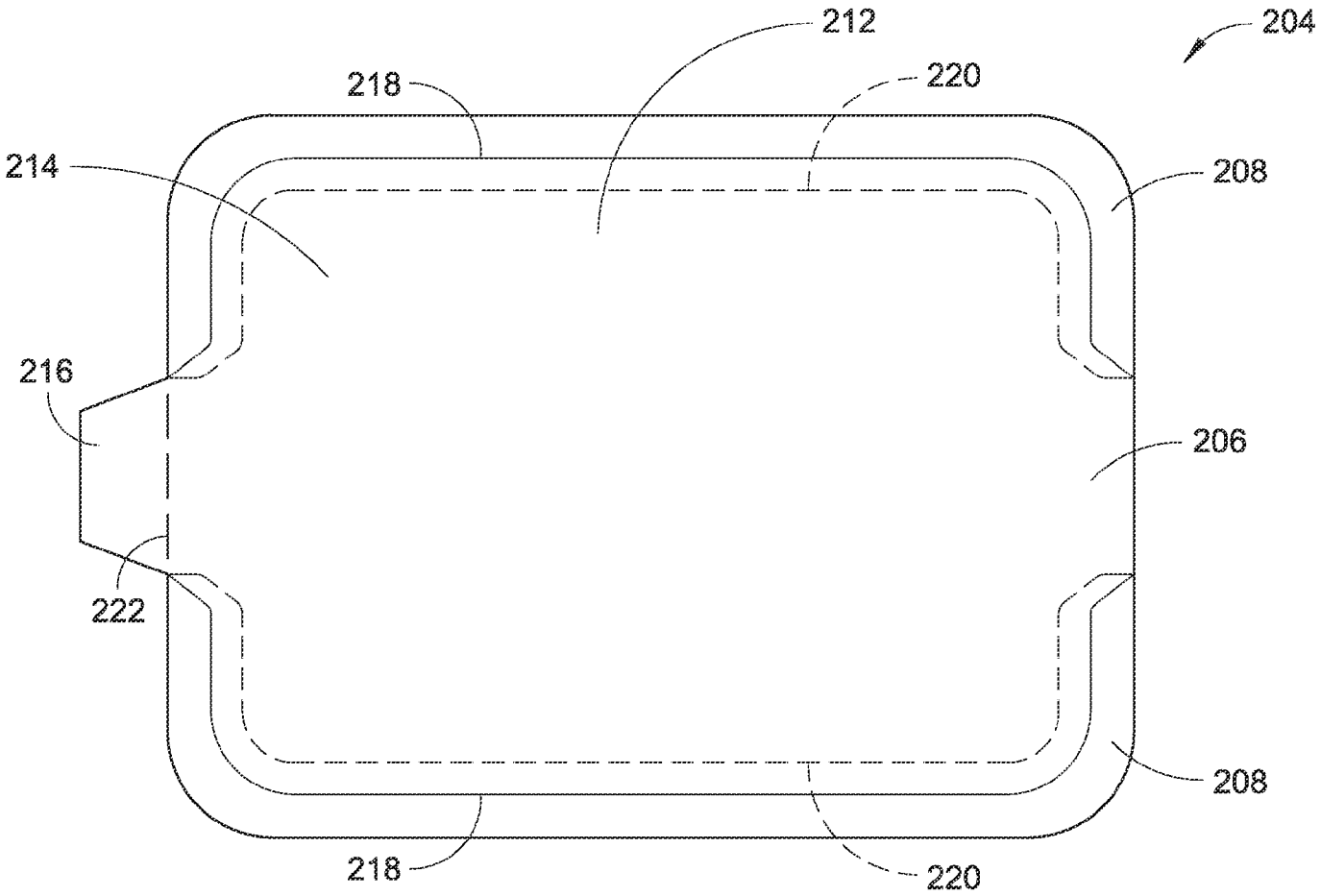

FIG. 14B is a top plan view of the lid illustrated in FIG. 14A, in accordance with example implementations of the present disclosure.

DETAILED DESCRIPTION

Aspects of the disclosure are described more fully hereinafter with reference to the accompanying drawings, which form a part hereof, and which show, by way of illustration, example features. The features can, however, be embodied in many different forms and should not be construed as limited to the combinations set forth herein; rather, these combinations are provided so that this disclosure will be thorough and complete, and will fully convey the scope. Among other things, the features of the disclosure can be facilitated by methods, devices, and/or embodied in articles of commerce. The following detailed description is, therefore, not to be taken in a limiting sense.

Overview

Container assemblies are described that include a first container and a second container, where the second container extends into and is supported by the first container. The first container defines an interior volume with an access opening that provides access to the interior volume. Thus, the first container can include multiple side panels extending in a generally upright orientation from a base panel. The second container also defines an interior volume with an access opening that provides access to the interior volume. Thus, the second container can also include multiple side panels extending in a generally upright orientation from a base panel. The first container can include a flange that extends at least partially around the periphery of its access opening. The second container can also include a flange that extends at least partially around the periphery of its access opening. The flange of the second container is configured to provide support for the second container via engagement with the flange of the first container.

The access opening that provides access to the interior volume of the first container can define an area greater than an area defined by the access opening that provides access to the interior volume of the second container. In this manner, the second container can extend into and be supported by the first container through engagement of the flange of the second container with the flange of the first container such that one or more of the side panels of the first container are not in contact with corresponding side panels of the second container. In implementations, the flange of the first container can define one or more recessed portions of a flange, and the flange of the second container can define one or more corresponding protruding flange portions (e.g., to facilitate removal of the second container from the first container).

The first container can be erected from a first blank (e.g., a foldable, unitary, single-sheet paperboard substrate) having a base portion with multiple side portions extending from the base portion. The first blank has an interior side and an exterior side. The interior side of the first blank can be coated (e.g., with polyethylene, polypropylene, and/or polyester). The first blank can also have multiple gusset portions, where each gusset portion extends between adjacent side portions. Each gusset portion can be folded and secured to an adjacent side portion. The second container can be erected from a second blank (e.g., a foldable, unitary, single-sheet paperboard substrate) having a base portion with multiple side portions extending from the base portion. The second blank has an interior side and an exterior side. Both the interior side and the exterior side of the second blank can be coated (e.g., with polyethylene, polypropylene, and/or polyester). The second blank can also have multiple flap portions, where each flap portion extends from a side portion. Each flap portion can be folded and secured to an adjacent side portion. In some instances, the second blank can define one or more apertures.

The container assembly can also include a lid for retaining the second container in the first container and/or for sealing to the first container and/or the second container. The lid can include an access feature for opening the container assembly to access the interior volume of the first container and/or the second container, and/or to remove the second container from the first container. For example, the lid can include a tear-away opening portion and a tab extending from the tear-away opening portion. A user can grasp and pull the tab to fully or partially remove the tear-away opening portion to access the interior volume of the first container and/or the second container, and/or to remove the second container from the first container (e.g., using a protruding flange portion).

The lid can be constructed using a third blank (e.g., a foldable, unitary, single-sheet paperboard substrate) having a cover portion with a seal portion. The third blank has an interior side and an exterior side. The interior side of the third blank can be coated (e.g., with polyethylene, polypropylene, and/or polyester). The seal portion can be configured to adhere the lid to the flange of the first container, extending at least partially around the periphery of the access opening of the first container. Thus, the flange of the first container can include a surface area sufficient for adhering the lid to the first container.

Example Implementations

FIGS. 1 through 14B illustrate example container assemblies 100 comprising a first container and a second container, where the second container extends into and is supported by the first container. A container assembly 100 includes a first container (e.g., a tray 102) and a second container (e.g., a basket 152). The first container is erected from a first blank (e.g., a tray blank 104) having a base portion (e.g., a generally rectangular-shaped base panel 106) with a number of side portions (e.g., four side panels 108 arranged in two sets of opposing pairs) extending from the base portion. The first blank has an interior side (e.g., interior side 110) and an exterior side (e.g., exterior side 112). The first blank also has a number of gusset portions (e.g., four gusset portions 114), where each gusset portion extends between adjacent side portions.

In implementations, the tray 102 can be constructed from a tray blank 104 configured as a foldable, unitary, single-sheet paperboard substrate (e.g., as illustrated in FIG. 12B). The paperboard substrate can include a smooth coating and/or can be polished to provide a finished surface with a high degree of smoothness for graphics printing or the like. For instance, the tray blank 104 can be formed from a coated paperboard substrate. The interior side 110 and/or the exterior side 112 of the tray blank 104 can be coated with one or more materials including, but not necessarily limited to: polyethylene, polypropylene, and/or polyester. For example, the interior side 110 of the tray blank 104 can be coated with PET. However, paperboard is provided by way of example only and is not meant to be restrictive of the present disclosure. Thus, the tray blank 104 can be formed using other materials, such as metal materials, plastic materials, and so forth. The tray blank 104 can also be constructed using multiple pieces, layers, and so forth, which can be joined together to form the tray blank 104. Further, for the purposes of the present disclosure, the term "coat" (and variations thereof, such as "coated" and "coating") are used to refer to one or more materials applied to a surface and/or the application of one or more materials to a surface using various techniques, including, but not necessarily limited to: extrusion coating, spray coating, lamination, and so forth.

The first container defines an interior volume with an access opening that provides access to the interior volume. For example, when the tray blank 104 is erected to form the tray 102, each side panel 108 extends in a generally upright orientation from the base panel 106 (i.e., with reference to a support surface upon which the base panel 106 rests). In this manner, the tray 102 defines an interior volume 116 with an access opening 118 that provides access to the interior volume 116. The interior volume 116 is defined proximate to the interior side 110 of the tray blank 104 so that the interior side 110 contacts the contents of an assembled tray 102. One or more of the side panels 108 can be disposed at an obtuse angle as measured from the base panel 106 (e.g., to facilitate stacking of the tray 102 and the basket 152). For instance, one or both sets of the pairs of opposing side panels 108 can include panels that extend generally upwardly and outwardly from the base panel 106 at obtuse angles as measured from the base panel 106. Thus, the interior volume 116 of the tray 102 can have a generally trapezoid-shaped profile with the longer parallel side of the trapezoid proximate to the access opening 118 and the shorter parallel side proximate to the base panel 106. However, this configuration is provided by way of example only and is not meant to be restrictive of the present disclosure. Thus, one or more of the side panels 108 can extend upwardly from the base panel 106 in another orientation, such as a substantially perpendicular orientation (e.g., about ninety degrees (90°)).

In example implementations, each pair of adjacent side panels 108 is connected together using the gusset portions 114. Each one of the gusset portions can be folded and secured to an adjacent side portion. For instance, each gusset portion 114 can be folded outwardly (e.g., with respect to the interior volume 116 of the tray 102) and secured to the exterior side 112 of the tray 102 at an adjacent side panel 108. Each one of the gusset portions 114 is configured so that the interior volume 116 of the tray 102 is capable of retaining liquid and/or semi-solid materials without leakage. For example, each pair of adjacent side panels 108 is hingedly connected together in a liquid-sealed manner using the gusset portion 114 extending between adjacent side panels 108. The gusset portions 114 can be secured to the side panels 108 using an adhesive applied between a folded gusset portion 114 and the exterior side 112 of the tray 102. The adhesive can be configured to resist melting when exposed to high temperatures. The gusset portions 114 can also be secured to the side panels 108 using heat sealing techniques. While the present disclosure describes connecting adjacent side panels 108 together using the gusset portions 114, it will be appreciated that the side panels 108 can be connected together using other structures and techniques, such as flaps, and so forth. For example, a pair of adjacent side panels 108 can be connected together using a flap portion extending from one side panel 108 and secured to an adjacent side panel 108.

The first container includes a flange (e.g., rim 120) that extends at least partially around the periphery of the access opening. In some implementations, the flange can extend at least substantially around the entirety of the access opening. For example, the rim 120 can extend around all four sides of the access opening 118 along each of the side panels 108. However, this configuration is provided by way of example only and is not meant to be restrictive of the present disclosure. In other implementations, a flange or rim can extend only partially around the access opening of the first container. For instance, the rim 120 can extend along one side of the access opening 118, two sides of the access opening 118, three sides of the access opening 118, and so forth. In a specific configuration, the rim 120 can include two separate rim portions 122 that extend along two opposing side panels 108. In the implementation illustrated in FIG. 12A, the rim 120 can include a first pair of opposing rim portions 122 that extend along a first pair of opposing side panels 108 and a second pair of opposing rim portions 124 that extend along a second pair of opposing side panels 108. In other implementations, a flange can comprise a single rim portion 122 and/or a single rim portion 124.

The tray blank 104 can have a number of cuts and/or creases to facilitate construction of the tray 102 from the tray blank 104. For example, the rim 120 can be formed by folding portions of the tray blank 104 outward and away from the interior volume 116 of the tray 102 at the access opening 118. The tray blank 104 can include one or more reverse percentage cuts 126 formed at a hinged connection between a rim portion 122 and/or 124 and one or more of the side panels 108. In implementations, a reverse percentage cut 126 can be formed by cutting and/or scoring through a fraction of the thickness of the tray blank 104 (e.g., about one-half (50%) of the thickness of the tray blank 104). In one particular configuration, the reverse percentage cuts 126 can comprise a series of cuts one-eighth of an inch (⅛") long and spaced one-eighth of an inch (⅛") apart. However, this configuration is provided by way of example only and is not meant to be restrictive of the present disclosure. Thus, other configurations can include more or fewer than four cuts, which can be differently sized and/or spaced-apart.

In example implementations, one or more of the rim portions 124 can be separated from an edge 128 of a gusset portion 114 along a through cut 130. The orientation (angle) of each through cut 130 with respect to a reverse percentage cut 126 can be matched to an orientation (angle) of an edge 132 of each rim portion 122. In this manner, when the side panels 108 are folded together, the rim portions 122 and the rim portions 124 can be configured to meet at through cuts 130 and edges 132 so that the rim 120 extends substantially around the entirety of access opening 118 and provides a substantially continuous flat surface. Thus, each rim portion 122 has a surface area defined by a reverse percentage cut 126, two edges 132, and the outside edge of the tray blank 104. Similarly, each rim portion 124 has a surface area defined by a reverse percentage cut 126, two through cuts 130, and the outside edge of the tray blank 104. However, this configuration is provided by way of example only and is not meant to be restrictive of the present disclosure. Thus, in other implementations, one or more of the rim portions 124 can be separated from a gusset portion 114 using another type of separation technique, such as a cutout, a notch, a perforation, and so forth.

The base panel 106 can be hingedly connected to the side panels 108 along creases 134. Thus, the base panel 106 has a surface area defined by the creases 134. Further, the side panels 108 can be hingedly connected to the gusset portions 114 along reverse creases 136. Thus, each side panel 108 has a surface area defined by one crease 134, two reverse creases 136, and one reverse percentage cut 126. One or more of the gusset portions 114, each of which has a surface area defined by two reverse creases 136 and edge 128, can include an interior crease 138 to facilitate folding of the gusset portions 114 outwardly from the interior volume 116 of the tray 102. The reverse percentage cuts 126, edges 128, through cuts 130, edges 132, creases 134, reverse creases 136, interior creases 138, and/or the outside edge of the tray blank 104 can be formed using cutting techniques, embossing techniques, and so forth. A predetermined folding sequence can then be used to erect the tray 102 (e.g., as previously described).

The second container (e.g., basket 152) is erected from a second blank (e.g., a basket blank 154) having a base portion (e.g., a generally rectangular-shaped base panel 156) with a number of side portions (e.g., four side panels 158 arranged in two sets of opposing pairs) extending from the base portion. The second blank has an interior side (e.g., interior side 160)

and an exterior side (e.g., exterior side 162). The second blank also has a number of flap portions (e.g., four flap portions 164), where each flap portion extends from a side portion.

In implementations, the basket 152 can be constructed from a basket blank 154 configured as a foldable, unitary, single-sheet paperboard substrate (e.g., as illustrated in FIG. 13B). The paperboard substrate can include a smooth coating and/or can be polished to provide a finished surface with a high degree of smoothness for graphics printing or the like. For instance, the basket blank 154 can be formed from a coated paperboard substrate. The interior side 160 and/or the exterior side 162 of the basket blank 154 can be coated with one or more materials including, but not necessarily limited to: polyethylene, polypropylene, and/or polyester. For example, both the interior side 160 and the exterior side 162 of the basket blank 154 can be coated with PET. However, paperboard is provided by way of example only and is not meant to be restrictive of the present disclosure. Thus, the basket blank 154 can be formed using other materials, such as metal materials, plastic materials, and so forth. The basket blank 154 can also be constructed using multiple pieces, layers, and so forth, which can be joined together to form the basket blank 154.

The second container defines an interior volume with an access opening that provides access to the interior volume. For example, when the basket blank 154 is erected to form the basket 152, each side panel 158 extends in a generally upright orientation from the base panel 156 (i.e., with reference to a support surface upon which the tray 102 rests when the basket 152 is supported in the tray 102). In this manner, the basket 152 defines an interior volume 166 with an access opening 168 that provides access to the interior volume 166. The interior volume 166 is defined proximate to the interior side 160 of the basket blank 154 so that the interior side 160 contacts the contents of an assembled basket 152. One or more of the side panels 158 can be disposed at an obtuse angle as measured from the base panel 156 (e.g., to facilitate stacking of the tray 102 and the basket 152). For instance, one or both sets of the pairs of opposing side panels 158 can include panels that extend generally upwardly and outwardly from the base panel 156 at obtuse angles as measured from the base panel 156. Thus, the interior volume 166 of the basket 152 can have a generally trapezoid-shaped profile with the longer parallel side of the trapezoid proximate to the access opening 168 and the shorter parallel side proximate to the base panel 156. However, this configuration is provided by way of example only and is not meant to be restrictive of the present disclosure. Thus, one or more of the side panels 158 can extend upwardly from the base panel 156 in another orientation, such as a substantially perpendicular orientation (e.g., about ninety degrees (90°)).

In example implementations, each pair of adjacent side panels 158 is connected together using the flap portions 164. Each one of the flap portions can be folded and secured to an adjacent side portion. For instance, each flap portion 164 can be folded outwardly (e.g., with respect to the interior volume 166 of the basket 152) and secured to the exterior side 162 of the basket 152 at an adjacent side panel 158. Each one of the flap portions 164 is configured so that the interior volume 166 of the basket 152 is capable of retaining solid or semi-solid materials. The flap portions 164 can be secured to the side panels 158 using an adhesive applied between a folded flap portion 164 and the exterior side 162 of the basket 152. The adhesive can be configured to resist melting when exposed to high temperatures. The flap portions 164 can also be secured to the side panels 158 using heat sealing techniques. While the present disclosure describes connecting adjacent side panels 158 together using the flap portions 164, it will be appreciated that the side panels 158 can be connected together using other structures and techniques, such as gussets, and so forth. For example, a pair of adjacent side panels 158 can be hingedly connected together using a gusset portion extending between adjacent side panels 158 (e.g., as previously described). In other implementations, adjacent side panels 158 can be connected together using a locking tab extending from one side panel 158, which can be inserted into a slit on an adjacent side panel 158 to form a tab lock.

The second container includes a flange (e.g., rim 170) that extends at least partially around the periphery of the access opening. The flange of the second container is configured to provide support for the second container via engagement with the flange of the first container. In some implementations, the flange can extend at least substantially around the entirety of the access opening. For example, the rim 170 can extend around all four sides of the access opening 168 along each of the side panels 158. However, this configuration is provided by way of example only and is not meant to be restrictive of the present disclosure. In other implementations, a flange or rim can extend only partially around the access opening of the second container. For instance, the rim 170 can extend along one side of the access opening 168, two sides of the access opening 168, three sides of the access opening 168, and so forth. In a specific configuration, the rim 170 can include two separate rim portions 172 that extend along two opposing side panels 158. In the implementation illustrated in FIG. 13A, the rim 170 can include a first pair of opposing rim portions 172 that extend along a first pair of opposing side panels 158. In other implementations, the rim 170 can include a second pair of opposing rim portions that extend along a second pair of opposing side panels 158. In other implementations, a flange can comprise a single rim portion 172.

The basket blank 154 can have a number of cuts and/or creases to facilitate construction of the basket 152 from the basket blank 154. For example, the rim 170 can be formed by folding portions of the basket blank 154 outward and away from the interior volume 166 of the basket 152 at the access opening 168. The basket blank 154 can include one or more through cuts 174 formed at a hinged connection between a rim portion 172 and one or more of the side panels 158. In implementations, a through cut 174 can be formed by cutting and/or scoring through the basket blank 154 (e.g., through the full thickness of the basket blank 154). In one particular configuration, the through cuts 174 can comprise a series of cuts one-eighth of an inch (⅛") long and spaced one-eighth of an inch (⅛") apart. Thus, each rim portion 172 has a surface area defined by the through cuts 174 and the outside edge of the basket blank 154. However, this configuration is provided by way of example only and is not meant to be restrictive of the present disclosure. Other configurations can include more or fewer cuts, which can be differently sized and/or spaced-apart.

The base panel 156 can be hingedly connected to the side panels 158 along creases 176. Thus, the base panel 156 has a surface area defined by the creases 176. Further, two of the side panels 158 can be hingedly connected to the flap portions 164 along creases 178, which facilitate folding of the flap portions 164 outwardly from the interior volume 166 of the basket 152. Thus, two of the side panels 158 each have a surface area defined by one crease 176, two creases 178, and the outside edge of the panel blank 154. The other two side panels 158 each have a surface area defined by one crease 176, the through cuts 174, and the outside edge of the panel blank 154. The flap portions 164 each have a surface area defined by a crease 178 and the outside edge of the panel blank 154. The through cuts 174, creases 176, creases 178, and/or the outside edge of the basket blank 154 can be formed using cutting techniques, embossing techniques, and so forth. A predetermined folding sequence can then be used to erect the basket 152 (e.g., as previously described).

The flange of the first container can define a recessed portion of a flange. For example, one or more of the rim portions 122 of the tray 102 can include an inwardly projecting notch 140. The inwardly projecting notch 140 can facilitate removal of the basket 152 from the tray 102 (e.g., by providing access to the rim 170 of the basket 152). Further, the flange of the second container can define a protruding flange portion. For instance, one or more of the rim portions 172 of the rim 170 can include an outwardly projecting tab 180. The outwardly projecting tab 180 can facilitate removal of the basket 152 from the tray 102 (e.g., by extending beyond the inwardly projecting notch 140 of the rim 120 of the tray 102). In this manner, the container assembly 100 can be configured so that a user can engage the basket 152 within the recessed portion of the rim 120 (e.g., to facilitate removal of the basket 152 from the tray 102).

It should be noted that while the accompanying figures describe two sets of inwardly projecting notches 140 and outwardly projecting tabs 180, this configuration is provided by way of example only and is not meant to be restrictive of the present disclosure. Thus, other example implementations can include more or fewer than two recessed portions of a flange and/or protruding flange portions. For example, the tray 102 and/or the basket 152 can include one recessed portion of a flange and/or protruding flange portion, three recessed portions of a flange and/or protruding flange portions, and so forth. Further, while the inwardly projecting notches 140 are described as disposed of the rim portions 122 of the tray 102, this configuration is provided by way of example only and is not meant to be restrictive. Thus, one or more recessed portions of a flange can also be disposed of the rim portions 124 of the tray 102. A recessed portion of a flange in this configuration can correspond to a similarly-oriented protruding flange portion on the basket 152, which can be disposed along a different side of the basket 152 than the outwardly projecting tabs 180 illustrated in the accompanying figures. In some instances, the basket 152 can define one or more apertures 182, which can be formed in the basket blank 154 using cutting techniques (e.g., as previously described). It should be noted that while the apertures 182 are described as generally elongated apertures in the accompanying illustrations, this aperture shape is provided by way of example only and is not meant to be restrictive of the present disclosure. Thus, in other configurations, apertures having different shapes can be provided, including circular apertures, rectangular (e.g., square) apertures, elliptical apertures, diamond-shaped apertures, trapezoidal-shaped apertures, X-shaped apertures, slit-shaped apertures, sinusoidal-shaped apertures, zigzag-shaped apertures, and so forth.

In implementations, the access opening 118 that provides access to the interior volume 116 of the tray 102 can define an area greater than an area defined by the access opening 168 that provides access to the interior volume 166 of the basket 152. In this manner, the basket 152 can extend into and be supported by the tray 102 through engagement of the rim 170 with the rim 120 of the tray 102 such that one or more of the side panels 108 are not in contact with corresponding ones of the side panels 158. Stated another way, a gap can be present between one or more of the side panels 108 and corresponding ones of the side panels 158. For example, a width $W_1$ defined between side panels 108 of the tray 102 at the access opening 118 can be greater than a width $W_2$ defined between side panels 158 of the basket 152 at the access opening 118. Additionally, a length $L_1$ defined between side panels 108 of the tray 102 at the access opening 118 can be greater than a length $L_2$ defined between side panels 158 of the basket 152 at the access opening 118. In some instances (e.g., where width $W_1$ is greater than width $W_2$ and length $L_1$ is greater than length $L_2$), the basket 152 can be supported in the tray 102 by the outwardly projecting tabs 180 so that the side panels 108 are not in contact with the side panels 158.

The container assembly 100 can include a lid 202 for retaining the second container (e.g., the basket 152) in the first container (e.g., the tray 102) and/or for sealing to the first container and/or the second container. The lid 202 can be constructed using a third blank (e.g., a lid blank 204) having a cover portion (e.g., a generally rectangular-shaped cover portion 206) with a seal portion (e.g., two seal portions 208). The third blank has an interior side (e.g., interior side 210) and an exterior side (e.g., exterior side 212). When the container assembly 100 is assembled, the interior side 210 is positioned adjacent to the interior volume 116 of the tray 102 at the access opening 118 so that the lid 202 encloses the contents of the tray 102.

In implementations, the seal portion can be configured to adhere the lid 202 to the flange (e.g., the rim 120) of the first container, extending at least partially around the periphery of the access opening of the first container. Thus, the flange of the first container can include a surface area sufficient for adhering one or more seal portions 208 of the lid 202 to the first container (e.g., to the interior side 110 of the tray 102 at the rim 120). The seal portions 208 can extend around four sides of the access opening 118 of the tray 102. However, this configuration is provided by way of example only and is not meant to be restrictive of the present disclosure. In other implementations, the seal portions 208 can extend only partially around the access opening of the first container. For instance, the seal portion can extend along one side of the access opening 118, two sides of the access opening 118, three sides of the access opening 118, and so forth. In a specific configuration, the seal portions 208 can extend along the rim portions 122 and the rim portions 124. In other implementations, the seal portions 208 can extend along two rim portions 122 or two rim portions 124. One or more of the seal portions 208 can be secured to the rim 120 using an adhesive applied between a seal portion 208 and the rim 120. The adhesive can be configured to resist melting when exposed to high temperatures. One or more of the seal portions 208 can also be secured to the rim 120 using heat sealing techniques.

The lid 202 can have an access feature for opening the container assembly 100 to access the interior volume of the first container and/or the second container, and/or to remove the second container from the first container. The access feature can include, but is not necessarily limited to: a perforated opening feature, a resealable opening feature, a tear-away opening feature, a tongue-and-groove opening feature, and so forth. In implementations, the seal portions 208 of the lid 202 are configured to seal to the rim 120 of the tray 102 without engaging the rim 170 of the basket 152. Thus, the basket 152 can be held within the container assembly 100 via the covering portion 206 and easily removed using the access feature of the lid 202. In this manner, a user can open the container assembly 100 using the access feature, grasp the second container, and remove the second container from the first container. For example, in some instances, the lid 202 can have a tear-away opening portion 214. The lid 202 can include a tab 216 extending from the tear-away opening portion 214. The tab 216 can be hingedly connected to the tear-away opening portion 214. A user can grasp and pull the tab 216 to fully or partially remove the tear-away opening portion 214 to access the interior volume of the tray 102 and/or the basket 152, and/or to remove the basket 152 from the tray 102 (e.g., using the outwardly projecting tabs 180). In some instances, when the lid 202 is sealed to the tray 102, the tab 216 can be folded downwardly (e.g., as illustrated in FIG. 10).

In implementations, the lid 202 can be constructed from a lid blank 204 configured as a foldable, unitary, single-sheet paperboard substrate (e.g., as illustrated in FIG. 14B). The paperboard substrate can include a smooth coating and/or can be polished to provide a finished surface with a high degree of smoothness for graphics printing or the like. For instance, the lid blank 204 can be formed from a coated paperboard substrate. The interior side 210 and/or the exterior side 212 of the lid blank 204 can be coated with one or more materials including, but not necessarily limited to: polyethylene, polypropylene, and/or polyester. For example, the interior side 210 of the lid blank 204 can be coated with PET. However, paperboard is provided by way of example only and is not meant to be restrictive of the present disclosure. Thus, the lid blank 204 can be formed using other materials, such as metal materials, plastic materials, and so forth. For example, the lid 202 can be formed using a substantially transparent, flexible film. The lid blank 204 can also be constructed using multiple pieces, layers, and so forth, which can be joined together to form the lid blank 204.

The lid blank 204 can have a number of cuts and/or creases to facilitate opening of the container assembly 100. The lid blank 204 can include one or more percentage cuts 218 and/or reverse percentage cuts 220 formed between the tear-away opening portion 214 and one or more of the seal portions 208. In implementations, a percentage cut 218 and/or a reverse percentage cut 220 can be formed by cutting and/or scoring through a fraction of the thickness of the lid blank 204 (e.g., about one-half (50%) of the thickness of the lid blank 204). In one particular configuration, the percentage cuts 218 and the reverse percentage cuts 220 can comprise two sets of two cuts each, positioned on opposite sides of the lid blank 204. In this manner, the tear-away opening portion 214 can be completely separable from an assembled container assembly 100. However, this configuration is provided by way of example only and is not meant to be restrictive of the present disclosure. Thus, other configurations can include more or fewer than four cuts, which can be differently sized and/or spaced-apart, and can facilitate complete or partial separation of the tear-away opening portion 214 from the container assembly 100. Further, separation of the tear-away opening portion 214 from one or more of the seal portions 208 can be provided using various separation techniques, such as cutouts, notches, perforations, and so forth.

The lid blank 204 can include one or more percentage cuts 222 formed at a hinged connection between the tear-away opening portion 214 and the tab 216. In implementations, a percentage cut 222 can be formed by cutting and/or scoring through the lid blank 204 (e.g., through the full thickness of the lid blank 204). In one particular configuration, the percentage cut 222 can comprise a series of cuts one-eighth of an inch (⅛") long and spaced one-eighth of an inch (⅛") apart. In this manner, the tear-away opening portion 214 has a surface area defined by two percentage cuts 218, a percentage cut 222, and the outside edge of the lid blank 204. Similarly, each seal portion 208 has a surface area defined by a reverse percentage cut 220 and the outside edge of the lid blank 204. The percentage cuts 218, reverse percentage cuts 220, and/or the percentage cuts 222 can be formed using cutting techniques, embossing techniques, and so forth.

One or more of the container assembly 100 components, such as the tray 102, the basket 152, and/or the lid 202, can include indicia, such as structural indicia, textual indicia, and/or image indicia. The term "structural indicia" can refer to structural portions of container assembly 100 components, such as packaging configurations, shapes, thicknesses, densities, and so forth. The term "textual indicia" can refer to letters, words, sentences, symbols, numbers, dialog, and so forth, which can be positioned (e.g., printed, impressed, embossed, and so forth) on the container assembly 100 components. The term "image indicia" can refer to photographs, pictures, drawings, paintings, holograms, icons, and so forth, which can be positioned on one or more components of the container assembly 100 (e.g., as previously described).

CONCLUSION

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A container assembly comprising:

a first container defining an interior volume with an access opening, the first container comprising a first flange extending at least partially around a periphery of the access opening, the first flange defining at least one inwardly projecting recessed portion of a flange, the first container erected from a first blank comprising an interior side and an exterior side, the first blank comprising a base portion with a plurality of side portions extending therefrom and a plurality of gusset portions, each one of the plurality of gusset portions extending between adjacent ones of the plurality of side portions, each one of the plurality of gusset portions folded and secured to an adjacent one of the plurality of side portions; and a second container extending into and supported by the first container, the second container defining an interior volume with an access opening, the second container comprising a second flange extending at least partially around a periphery of the access opening and configured to provide support for the second container via engagement with the first flange of the first container.

2. The container assembly as recited in claim 1, wherein the second flange defines at least one protruding flange portion corresponding to the at least one recessed portion of a flange of the first container.

3. The container assembly as recited in claim 1, wherein the second container is erected from a second blank comprising an interior side and an exterior side, the second blank comprising a base portion with a plurality of side portions extending therefrom and a plurality of flap portions, each one of the plurality of flap portions extending from one of the plurality of side portions and secured to another adjacent one of the plurality of side portions.

4. The container assembly as recited in claim 3, wherein the interior side and the exterior side of the second blank are coated with at least one member of a group consisting of: polyethylene, polypropylene and polyester.

5. The container assembly as recited in claim 1, wherein the interior side of the first blank is coated with at least one member of a group consisting of: polyethylene, polypropylene and polyester.

6. The container assembly as recited in claim 1, wherein the access opening of the first container defines a first area greater than a second area defined by the access opening of the second container.

7. The container assembly as recited in claim 1, further comprising a lid for at least one of retaining the second container in the first container or sealing to at least one of the first container or the second container, the lid constructed from a third blank comprising an interior side and an exterior side, the third blank comprising a cover portion and a seal portion, the seal portion configured to adhere the lid to the flange of the first container at least partially around the access opening of the first container.

8. The container assembly as recited in claim 7, wherein the lid comprises an access feature for opening the container assembly.

9. The container assembly as recited in claim 7, wherein the interior side of the third blank is coated with at least one member of a group consisting of: polyethylene, polypropylene and polyester.

10. A foldable container system comprising:

a first blank configured to be folded into a first container defining an interior volume with an access opening, the first blank comprising a substrate having an interior side and an exterior side and comprising:

a base portion;

a plurality of side portions extending from the base portion;

a plurality of gusset portions, each one of the plurality of gusset portions extending between adjacent ones of the plurality of side portions, each one of the plurality of gusset portions configured to be folded and secured to an adjacent one of the plurality of side portions, and a first flange disposed of at least one of the plurality of side portions and configured to extend at least partially around a periphery of the access opening, the first flange defining at least one recessed portion of a flange; and a second blank configured to be folded into a second container defining an interior volume with an access opening, the second container configured to extend into the first container for support by the first container, the second blank comprising a substrate having an interior side and an exterior side and comprising:

a base portion;

a plurality of side portions extending from the base portion; and a second flange disposed of at least one of the plurality of side portions and configured to extend at least partially around a periphery of the access opening and configured to provide support for the second container via engagement with the first flange of the first container.

11. The foldable container system as recited in claim 10, wherein the second flange defines at least one protruding flange portion corresponding to the at least one recessed portion of a flange of the first container.

12. The foldable container system as recited in claim 10, wherein the second blank further comprises a plurality of flap portions, each one of the plurality of flap portions extending from one of the plurality of side portions and configured to be secured to another adjacent one of the plurality of side portions.

13. The foldable container system as recited in claim 10, wherein the interior side and the exterior side of the second blank are coated with at least one member of a group consisting of: polyethylene, polypropylene and polyester.

14. The foldable container system as recited in claim 10, wherein the interior side of the first blank is coated with at least one member of a group consisting of: polyethylene, polypropylene and polyester.

15. The foldable container system as recited in claim 10, wherein the access opening of the first container defines a first area greater than a second area defined by the access opening of the second container.

16. The foldable container system as recited in claim 10, further comprising a third blank configured as a lid for at least one of retaining the second container in the first container or sealing to at least one of the first container or the second container, the third blank comprising a substrate having an interior side and an exterior side and comprising a cover portion and a seal portion, the seal portion configured to adhere the lid to the flange of the first container at least partially around the access opening of the first container.

17. The foldable container system as recited in claim 16, wherein the lid comprises an access feature for opening the container assembly.

18. The foldable container system as recited in claim 16, wherein the interior side of the third blank is coated with at least one member of a group consisting of: polyethylene, polypropylene and polyester.

19. A container assembly comprising:

a first container defining an interior volume with an access opening, the first container comprising a first flange extending at least partially around a periphery of the access opening, the first flange defining at least one recessed portion of a flange, the first container erected from a first blank comprising an interior side and an exterior side, the first blank comprising a base portion with a plurality of side portions extending therefrom and a plurality of gusset portions, each one of the plurality of gusset portions extending between adjacent ones of the plurality of side portions, each one of the plurality of gusset portions folded and secured to an adjacent one of the plurality of side portions;

a second container extending into and supported by the first container, the second container defining an interior volume with an access opening, the second container comprising a second flange extending at least partially around a periphery of the access opening and configured to provide support for the second container via engagement with the first flange of the first container, the second flange defining at least one protruding flange portion corresponding to the at least one recessed portion of a flange of the first container, the second container erected from a second blank comprising an interior side and an exterior side, the second blank comprising a base portion with a plurality of side portions extending therefrom and a plurality of flap portions, each one of the plurality of flap portions extending from one of the plurality of side portions and secured to another adjacent one of the plurality of side portions; and a lid for retaining the second container in the first container, the lid comprising an access feature for opening the container assembly, the lid constructed from a third blank comprising an interior side and an exterior side, the third blank comprising a cover portion and a seal portion, the seal portion configured to adhere the lid to the flange of the first container at least partially around the access opening of the first container.

20. The container assembly as recited in claim 19, wherein the access opening of the first container defines a first area greater than a second area defined by the access opening of the second container.

* * * * *